US011591855B2

(12) United States Patent
Pettit

(10) Patent No.: US 11,591,855 B2
(45) Date of Patent: Feb. 28, 2023

(54) IN POOL LADDER ASSEMBLY

(71) Applicant: Frederick M. Pettit, Fonthill (CA)

(72) Inventor: Frederick M. Pettit, Fonthill (CA)

( * ) Notice: Subject to any disclaimer, the term of this patent is extended or adjusted under 35 U.S.C. 154(b) by 475 days.

(21) Appl. No.: 16/423,721

(22) Filed: May 28, 2019

(65) Prior Publication Data

US 2020/0378184 A1 Dec. 3, 2020

(51) Int. Cl.

| | |
|---|---|
| ***E06C 7/08*** | (2006.01) |
| ***E04H 4/14*** | (2006.01) |
| ***E06C 7/06*** | (2006.01) |
| ***E06C 7/42*** | (2006.01) |
| ***E06C 1/34*** | (2006.01) |

(52) U.S. Cl.

CPC ..... *E06C 7/087* (2013.01); *E04H 4/144* (2013.01); *E06C 1/34* (2013.01); *E06C 7/06* (2013.01); *E06C 7/426* (2013.01)

(58) Field of Classification Search

CPC ..... E06C 7/06; E06C 7/44; E06C 7/46; E06C 7/423; E06C 7/426; E06C 7/08; E06C 7/087; E06C 1/34; E06C 7/083; E06C 7/182; E06C 7/084; E06C 7/085; E04H 4/144

See application file for complete search history.

(56) References Cited

U.S. PATENT DOCUMENTS 2,194,856 A * 3/1940 Kostuk ..... E06C 7/44 182/195
3,776,650 A * 12/1973 Zenhausern ..... F16B 12/40 403/233
3,908,795 A * 9/1975 Gannon ..... E06C 7/16 182/118
4,009,904 A * 3/1977 Sheldon ..... A47D 1/00 248/362
4,415,062 A * 11/1983 Shaw ..... E06C 7/46 182/109
4,603,758 A * 8/1986 Pettit ..... E06C 1/26 182/194
4,744,441 A * 5/1988 Sandstrom ..... E06C 7/44 182/201

(Continued)

FOREIGN PATENT DOCUMENTS

EP 2113631 A1 * 11/2009 ..... E04H 4/144

*Primary Examiner* — Daniel P Cahn
*Assistant Examiner* — Shiref M Mekhaeil
(74) *Attorney, Agent, or Firm* — Tucker Ellis LLP; Heather M. Barnes

(57) ABSTRACT

A pool ladder may have a first and second leg extension, each having a generally continuous profile; a first tread may comprise first and second through-holes, the first through-hole being sized to slidingly receive the generally continuous profile of the first leg extension, and the second through-hole being sized to slidingly receive the generally continuous profile of the second leg extension; and a first and second tread support. The first tread support may be engaged at a tread location on the first leg extension and may be separate from the first leg extension. The second tread support may be engaged at a tread location on the second leg extension and may be separate from the second leg extension. Each of the first and second tread supports may protrude from the respective leg extension a sufficient amount to prevent the first and second through-holes from sliding past the tread locations.

20 Claims, 16 Drawing Sheets

(56) References Cited

U.S. PATENT DOCUMENTS 4,989,692 A * 2/1991 Min ..... E06C 1/39 182/24
5,417,302 A * 5/1995 McElfresh ..... E06C 7/46 182/230
5,547,041 A * 8/1996 Morral Gispert ..... E06C 7/08 182/228.4
5,743,355 A * 4/1998 McDonnell ..... E06C 1/125 182/195
6,520,291 B2 * 2/2003 Andrey ..... A01M 31/02 182/195
8,011,475 B2 * 9/2011 Wang ..... E06C 7/42 182/228.3
9,260,917 B2 * 2/2016 Weston ..... E06C 7/48
10,233,692 B2 * 3/2019 Kieffer ..... E06C 1/125
10,240,394 B1 * 3/2019 Crampton ..... E06C 7/081
10,435,946 B2 * 10/2019 Nielsen ..... E06C 7/08
D872,880 S * 1/2020 Wang ..... D25/64
10,961,777 B2 * 3/2021 Bernhardsson ..... E06C 1/125
2004/0020718 A1 * 2/2004 Kieffer ..... E06C 7/06 182/195
2004/0195043 A1 * 10/2004 Johansson ..... E06C 1/125 182/195
2005/0082117 A1 * 4/2005 Morral Gispert ..... E04H 4/144 182/93
2005/0092551 A1 * 5/2005 Caldwell ..... E06C 7/46 182/204
2006/0283664 A1 * 12/2006 Yao ..... E06C 7/06 182/156
2007/0125602 A1 * 6/2007 Marbach ..... E06C 7/083 182/228.1
2007/0209875 A1 * 9/2007 Chen ..... E06C 1/125 182/195
2007/0267252 A1 * 11/2007 Yao ..... E06C 1/125 182/195
2008/0000723 A1 * 1/2008 Kieffer ..... E06C 1/125 182/195
2008/0023269 A1 * 1/2008 Parker ..... E04F 11/068 182/195
2009/0050407 A1 * 2/2009 Eriksson ..... E06C 1/18 182/195
2009/0065304 A1 * 3/2009 Jian ..... E06C 1/125 182/209
2009/0078503 A1 * 3/2009 Eriksson ..... E06C 1/22 182/104
2009/0224117 A1 * 9/2009 Kaneda ..... F16B 47/00 248/205.5
2009/0294608 A1 * 12/2009 Brassard ..... F16B 47/00 248/205.5
2010/0044155 A1 * 2/2010 Kieffer ..... E06C 1/125 182/195
2010/0071996 A1 * 3/2010 Huang ..... E04G 1/34 182/118
2010/0270106 A1 * 10/2010 Chen ..... E06C 1/125 182/195
2011/0056764 A1 * 3/2011 Cross ..... E06C 1/32 182/27
2011/0192679 A1 * 8/2011 Kuo ..... E06C 1/125 182/195
2012/0267197 A1 * 10/2012 Kieffer ..... E06C 1/125 182/194
2013/0025042 A1 * 1/2013 Lin ..... E04H 4/144 4/494
2013/0048427 A1 * 2/2013 Sordo ..... E06C 7/46 182/110
2017/0152708 A1 * 6/2017 Lin ..... E04H 4/144
2018/0127997 A1 * 5/2018 Hsu ..... E04H 4/06
2018/0230746 A1 * 8/2018 Maxfield ..... E06C 7/423
2018/0327002 A1 * 11/2018 Nasrabad ..... E06C 7/04
2019/0119985 A1 * 4/2019 Bernhardsson ..... E06C 1/22
2019/0128064 A1 * 5/2019 Bernhardsson ..... E06C 1/125
2019/0136623 A1 * 5/2019 Kieffer ..... F16B 7/105

* cited by examiner

IN POOL LADDER ASSEMBLY

TECHNICAL FIELD

The present disclosure relates to swimming pool ladders.

BACKGROUND

Above ground and in ground pools generally require some sort of step or ladder apparatus to help users in and out of the pool. Some examples of step or ladder apparatuses may be pool steps, a ladder that secures to a deck or platform, and an A-frame type ladder for above ground pools. The pool steps may be similar to stairs in a home or office and would generally secure to the deck or platform of the above or in ground pool.

Ladders for above ground pools are usually designed with one deck height in mind. Pool ladders may be designed for different deck heights of between about 48 inches and about 60 inches. This means that pool ladder manufacturers have to take time to design and manufacture different models of ladders for various different deck heights. When companies are designing and manufacturing the pool ladders, the ladders should comply with the Association of Pool and Spa Professional (APSP) ladder codes. The APSP ladder codes state that the treads in all ladders should have a uniform riser height of between 7 inches at a minimum and 12 inches at a maximum. An exception is that the riser height of the bottom tread may vary from the other riser heights; however, the riser height cannot be less than 7 inches or greater than 12 inches.

Pool steps and ladders may be purchased in store or over the Internet. Once purchased, the ladders may be shipped or delivered to the users, however shipping or delivering assembled ladders may be difficult and costly due to the large size of the ladders. When the ladders are shipped unassembled, the company shipping or manufacturing the ladder components have to ensure that each component required for assembly is included in the box before shipment. Components of pool ladders are usually made of a combination of plastic, and metal components and fasteners. The various plastic components may be molded using multiple mold presses or cavities. Having to collect each of the different components, such as plastic components, metal nuts, bolts, washers etc. after they are manufactured using the different processes requires additional time and/or resources and may mean that a component may be forgotten or left out of the shipping container.

Pool ladders that require assembly once they are received by the user, also require the user to have the right tools at their home for the assembly. When there are many screws, bolts, or nuts included in the assembly of the pool ladder, the user may need the right sizes of tools for the different screws, bolts, and nuts in order to assemble the ladder. If the user does not have the necessary tools, assembly may be difficult or impossible.

Accordingly, an additional, alternative and/or improved pool ladder that may be assembled by a user is desirable.

SUMMARY

In accordance with the present disclosure there is provided a pool ladder that may comprise: a first leg extension and a second leg extension, each having a generally continuous profile; a first tread may comprise a first through-hole and a second through-hole, the first through-hole may be sized to slidingly receive the generally continuous profile of the first leg extension, and the second through-hole may be sized to slidingly receive the generally continuous profile of the second leg extension; and a first tread support and a second tread support, the first tread support may be engageable to the first leg extension at a first tread location along the first leg extension, the second tread support may be engageable to the second leg extension at a first tread location on the second leg extension, each of the first and second tread support, when engaged to the respective leg extension, protruding from the respective leg extension a sufficient amount to prevent the first and second through-holes of the first tread from sliding past the tread support.

In a further implementation of the pool ladder, the pool ladder may further comprise: a base component comprising a first pocket and a second pocket, the first pocket may be sized to receive a bottom end of the first leg extension, the second pocket being sized to receive a bottom end of the second leg extension.

In a further implementation of the pool ladder, the base component may be pivotably connected to the first leg extension and the second leg extension.

In a further implementation of the pool ladder: the first leg extension may comprise a first tab protruding from the bottom end of the first leg extension; the second leg extension may comprise a second tab protruding from the bottom end of the second leg extension; and the first pocket and the second pocket each may comprise a curved bottom surface with a slotted opening, the first tab may be slidably connected to the slotted opening of the first pocket, the second tab may be slidably connected to the slotted opening of the second pocket.

In a further implementation of the pool ladder, the bottom end of the first leg extension may comprise a first base support protruding from opposite sides of the first leg extension; the bottom end of the second leg extension may comprise a second base support protruding from opposite sides of the second leg extension; a top edge of a side of the first pocket and a top edge of an opposite side of the first pocket each may comprise a curved recess, each of the curved recesses of the first pocket may be shaped to pivotably receive the first base support; and a top edge of a side of the second pocket and a top edge of an opposite side of the second pocket each may comprise a curved recess, each of the curved recesses of the second pocket may be shaped to pivotably receive the second base support.

In a further implementation of the pool ladder, the base component may be formed of two components; and a first component of the base component may comprise the first pocket, and a second component of the base component may comprise the second pocket.

In a further implementation of the pool ladder, the base component may be one component comprising both the first pocket and the second pocket.

In a further implementation of the pool ladder, the pool ladder may further comprise: a first handrail removably connected to a top end of the first leg extension; and a second handrail removably connected to a top end of the second leg extension, wherein the first handrail may be slidingly received within the first leg extension, and the second handrail may be slidingly received within the second leg extension.

In a further implementation of the pool ladder, the first and second handrails may be slidingly received through an opening in a top surface of the respective first and second leg extensions.

In a further implementation of the pool ladder, the first and second handrails may be slidingly received through an opening in a top surface and an upper portion of a side surface of the respective first and second leg extensions.

In a further implementation of the pool ladder, both a side edge and an opposite side edge of each of the openings in the first and second leg extensions may comprise a recess, each of the recesses may receive handrail supports; each of the first handrail and the second handrail may comprise at least two of the handrail supports; and one of the handrail supports may protrude from a side of the first and second handrails and another handrail support may protrude from an opposite side of the first and second handrails. In an implementation, the first and second handrails may be made of metal or plastic.

In a further implementation of the pool ladder, the pool ladder may further comprise: a top tread comprising a first through-hole and a second through-hole, the first through-hole of the top tread may be sized to slidingly receive the connection of the first handrail and the first leg extension, and the second through-hole of the top tread may be sized to slidingly receive the connection of the second handrail and the second leg extension; and a third tread support and a fourth tread support, the third tread support may be engaged at a top tread location on the first leg extension and may be separate from the first leg extension, the fourth tread support may be engaged at a top tread location on the second leg extension and may be separate from the second leg extension, each of the third and fourth tread supports may protrude from the respective leg extension a sufficient amount when engaged to prevent the first and second through-holes of the top tread from sliding past the top tread locations.

In a further implementation of the pool ladder, the pool ladder may further comprise: a second tread comprising a first through-hole and a second through-hole, the first through-hole of the second tread may be sized to slidingly receive the generally continuous profile of the first leg extension, and the second through-hole of the second tread may be sized to slidingly receive the generally continuous profile of the second leg extension; and a fifth tread support and a sixth tread support, the fifth tread support may be engaged at a second tread location on the first leg extension and may be separate from the first leg extension, the second tread support may be engaged at a second tread location on the second leg extension and may be separate from the second leg extension, each of the fifth and sixth tread supports may protrude from the respective leg extension a sufficient amount when engaged to prevent the first and second through-holes of the second tread from sliding past the second tread locations.

In a further implementation of the pool ladder, the pool ladder may further comprise: a third tread comprising a first through-hole and a second through-hole, the first through-hole of the third tread may be sized to slidingly receive the generally continuous profile of the first leg extension, and the second through-hole of the third tread may be sized to slidingly receive the generally continuous profile of the second leg extension; and a seventh tread support and an eighth tread support, the seventh tread support may be engaged at a third tread location on the first leg extension and may be separate from the first leg extension, the eighth tread support may be engaged at a third tread location on the second leg extension and may be separate from the second leg extension, each of the seventh and eighth tread supports may protrude from the respective leg extension a sufficient amount when engaged to prevent the first and second through-holes of the third tread from sliding past the third tread locations.

In accordance with the present disclosure, there is provided a kit for assembling a pool ladder, the kit may comprise: a first leg extension; a second leg extension; a first tread; a first tread support; and a second tread support.

In a further implementation of the kit, the kit may further comprise: a base component.

In a further implementation of the kit, the kit may further comprise: a first handrail; and a second handrail.

In a further implementation of the kit, the kit may further comprise: a top tread; a third tread support; and a fourth tread support. The kit may further comprise a second tread, a fifth tread support, and a sixth tread support. The kit may further comprise a third tread, a seventh tread support, and an eight tread support. The kit may further comprise two flanges.

In accordance with the present disclosure there is provided a method of producing the kit, which may comprise molding the kit parts.

In a further implementation of the method, the kit parts may be molded in a single mold.

BRIEF DESCRIPTION OF THE DRAWINGS

Further features and advantages of the present disclosure will become apparent from the following detailed description, taken in combination with the appended drawings, in which.

DETAILED DESCRIPTION

An in-pool ladder is described that can be easily assembled by the end-user. The ladder comprises a pair of leg extensions that slide through corresponding holes in treads. Tread supports may then be engaged to the leg extensions in order to prevent the treads from sliding down further on the leg extensions and so fix the treads in place. Handrails may be connected to the top of the leg extensions. Flanges can be connected to the handrails, which may be used to secure the ladder to a deck of the pool. The flanges may slide on the handrails in order to allow the ladder to be used with different deck heights. The ladder may be assembled by engaging the ladder supports to the leg extensions and sliding the treads over the leg extensions onto the supports. The ladder supports may be engaged with the leg extensions without the use of tools and as such, the ladder can be easily assembled by a user without the use of tools.

A majority of the ladder components, including assembly components, may be formed from plastic. The plastic components of the pool ladder may be formed by a single mold process, which allows all of the plastic components to be formed in a single mold at the same time. In this way, when the ladder components are being boxed, there may be a much lower risk of missing or accidently omitting components required to assemble the ladder, since all components for a ladder are formed in a single mold. The components of the ladder may be formed by a single mold process; however, they may also be formed by a combination of processes including for example extrusion, rolling, or many other manufacturing processes.

Implementations of the pool ladder will be further described below with reference to the figures.

Figure 1A:
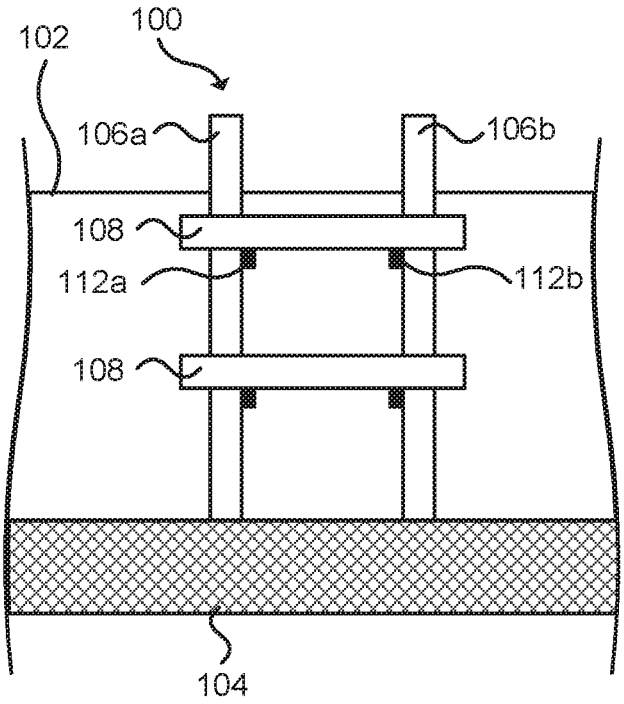
FIG. 1A depicts the pool ladder in a pool.

FIG. 1A is a schematic of a pool ladder 100 in a pool. The ladder 100 may be secured to a deck surface 102 and rest on a bottom pool surface 104. The ladder 100 may be formed of leg extensions 106*a*, 106*b* which each have a generally continuous profile, and a tread 108. The continuous profile may be circular in shape as depicted or may be semi-rectangular or other shapes. The leg extension 106*a*, 106*b* has the same general profile shape over a substantial portion of the length of leg extension 106*a*, 106*b*. As shown in FIG. 1C, the tread 108 may have through-holes 110*a* and 110*b* having a corresponding shape to the profile of the leg extension. The through-holes 110*a*, 110*b* may be located at opposite ends of the tread 108. The through-holes 110*a*, 110*b* may be fully enclosed or surrounded by the tread 108 material and may be sized so that each leg extension 106*a*, 106*b* can be slidingly received within one of the through-holes 110*a*, 110*b*. If the leg extensions 106*a*, 106*b* each have the same generally continuous profile, then each through-hole 110*a*, 110*b* in the tread 108 may have a similar shape to the generally continuous profile of the leg extensions 106*a*, 106*b*. If the leg extensions 106*a*, 106*b* each have a different generally continuous profile, then one of the through-holes 110*a*, 110*b* may have a shape matching the generally continuous profile of one of the leg extensions 106*a*, 106*b* and the other through-hole 110*a*, 110*b* may have a shape matching the generally continuous profile of the other leg extension 106*a*, 106*b*. The generally continuous profile of the leg extensions 106*a*, 106*b* may have approximately the same shape and size extending the full length of the leg extension 106*a*, 106*b*. It will be appreciated that the generally continuous profile may be round, rectangular, triangular, or another shaped profile or the profile may be inconsistent, where a profile at the top end or bottom end of the leg extension 106*a*, 106*b* may be larger or smaller than the opposite end. It will also be appreciated that the leg extensions 106*a*, 106*b* may each be formed from a single piece or may each be formed of multiple pieces connected together.

The tread 108 may connect to the leg extensions 106*a*, 106*b* using tread supports 112*a*, 112*b*. The tread support 112*a*, 112*b* may engage with the leg extensions 106*a*, 106*b*, for example by snapping into a hole 114*a*, 114*b* on each of the leg extensions 106*a*, 106*b*. The tread support 112*a*, 112*b* may engage with the hole 114*a*, 114*b* so that it protrudes a sufficient amount from a side of the leg extension 106*a*, 106*b*. Although depicted as engaging with the leg extensions 106*a*, 106*b* at an inner side of the leg extensions 106*a*, 106, the tread supports 112*a*, 112*b* may engage at any side of the leg extensions 106*a*, 106*b*. When engaged with the leg extension 106*a*, 106*b*, the tread support 112*a*, 112*b* protrudes from the leg extension 106*a*, 106*b* in order to prevent the leg extensions 106*a*, 106*b* from sliding further in the through-holes 110*a*, 110*b* of the tread 108.

Figure 1B:
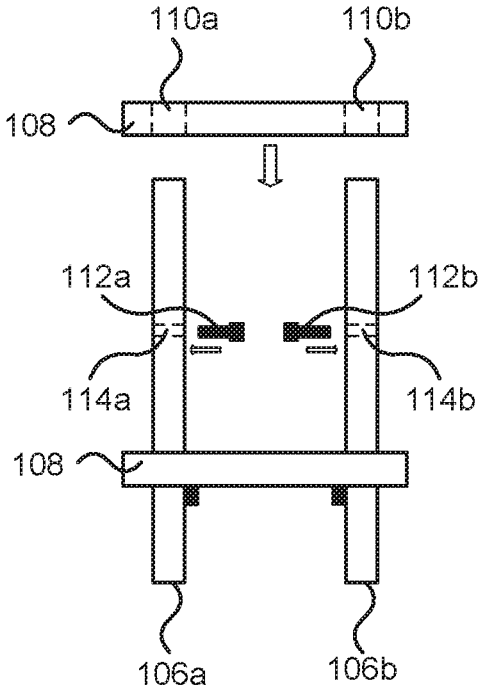
FIGS. 1B and 1C depict an assembly of the pool ladder.
Figure 1C:
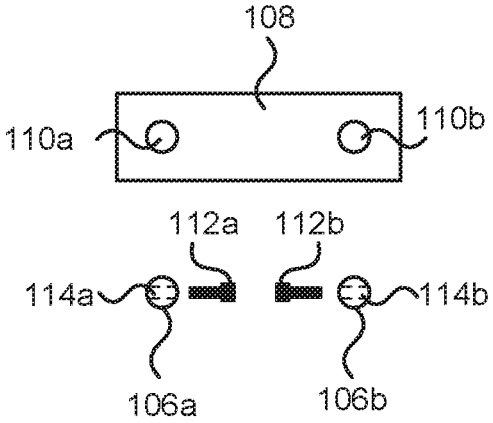

FIG. 1B depicts the assembly of the tread 108 onto the leg extensions 106*a*, 106*b*. The user may place a tread support 112*a*, 112*b* into a hole 114*a*, 114*b* in each of the leg extensions 106*a*, 106*b*. The tread 108 may then be slidingly received by the leg extensions 106*a*, 106*b* through the through-holes 110*a*, 110*b* of the tread 108. When the tread 108 slides over the leg extensions 106*a*, 106*b*, the protruding tread supports 112*a*, 112*b* prevent the tread 108 from sliding further and so secure the tread 108 at the location of the tread supports 112*a*, 112*b* in the holes 114*a*, 114*b*. The tread supports 112*a*, 112*b* protrude from the leg extensions 106*a*, 106*b* a sufficient amount so as to prevent the tread 108 from sliding past the location of the tread supports 112*a*, 112*b* on the leg extension 106*a*, 106*b*. The tread supports 112*a*, 112*b* may also support a portion of the expected weight on the tread during use. While the ladder 100 is depicted as having two treads, it is possible for a ladder to have a single tread or three or more treads.

Figure 2A:
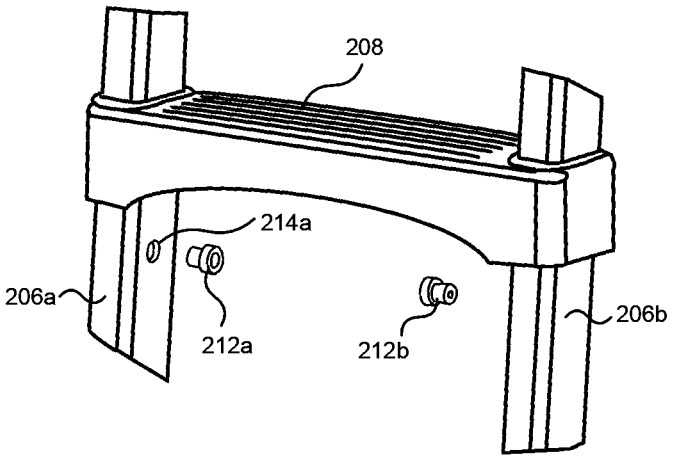
FIG. 2A depicts an assembly of a tread on leg extensions.
Figure 2B:
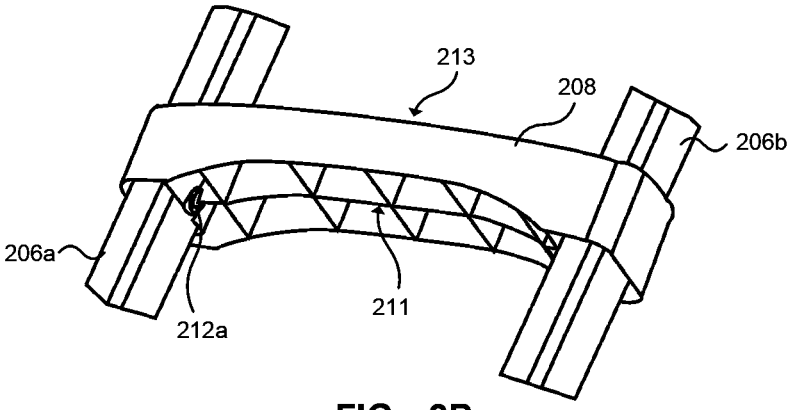
FIG. 2B depicts a bottom view of the tread assembled onto the leg extensions.

FIGS. 2A and 2B depict a tread 208 secured to leg extensions 206*a*, 206*b*. The tread 208 comprises a pair of through-holes into which the leg extensions 206*a*, 206*b* can slide. Tread supports 212*a*, 212*b* can be inserted into corresponding holes 214*a*, 214*b* in each of the leg extensions 206*a*, 206*b*. When the tread 208 is slidingly received over the leg extensions 206*a*, 206*b*, the bottom surface of tread 208 contacts the tread supports 212*a*, 212*b*, which prevents the tread from sliding further on the leg extension. Accordingly, the protruding tread supports secure the tread 208 at the tread support 212*a*, 212*b* location, as shown in FIG. 2B.

To secure the connection of the tread 208 onto the leg extensions 206*a*, 206*b*, the treads 208 may further comprise ridges or reinforcing ribs on a bottom side as shown in FIG. 2B. A center reinforcing rib 211 that extends along a length of the tread 208, may be used to prevent the tread support 212*a*, 212*b* from coming out of the holes 214*a*, 214*b* in the leg extensions 206*a*, 206*b*. To further secure this connection when the ladder 100 is in use, the tread 208 may have a camber 213 built into the top of it so that when the tread 208 is loaded or a user is stepping on it, the deflection caused by the weight of the user causes the tread 208 to deflect. This deflection of the tread 208 may push the center reinforcing rib outward, pushing the tread supports 212*a*, 212*b* into the holes 214*a*, 214*b*.

As shown in FIG. 2A, the tread 208 may have small ribs extending from one end of the tread 208 to the opposite end. The ribs may be anti-skid ribs, which can be used to prevent slippage when the user is stepping on the treads 208 to enter or exit the pool. The tread 208 may also have small holes on its surface that are used to release air from underneath the tread 208 when the ladder is placed underwater. By releasing the air, the holes prevent any floatation of the ladder when it is in the pool. The tread 208 may further comprise curved recesses at a bottom side of the through-holes 210*a*, 210*b*. The curved recesses may be on a bottom edge of opposite sides of the through-holes 210*a*, 210*b*.

Figure 3:
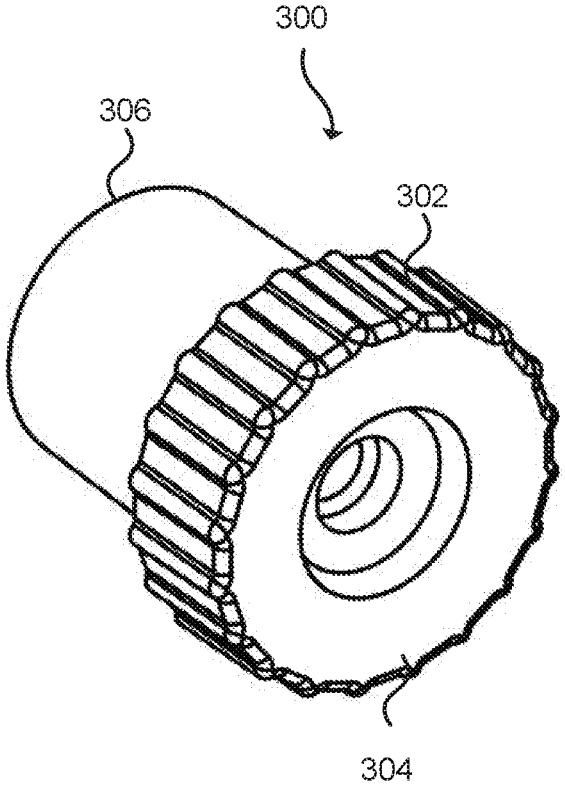
FIG. 3 depicts a tread support.

FIG. 3 depicts details of a tread support 300. The tread support 300 may be used as the tread supports 212*a*, 212*b*. The tread support 300 has a bolt type shape with an enlarged head portion 304 with an extending pin section 306. The head portion 304 may have a plurality of small ribs 302 distributed about a side wall of the head section 304. The small ribs 302 may be deformed when inserting the tread support 300 into a corresponding hole or recess in the leg extension 206*a*, 206*b* and as such may provide a strong interference fit without requiring a precise fit between the two parts. The ribs 302 may also provide an interference fit with a corresponding recess or structure in the bottom of the tread 208 in order to secure the tread 208 to the leg extensions 206*a*, 206*b*. It will be appreciated that although the head portion 304 of the tread support 300 is depicted as having small ribs 302, the head portion 304 may have solid side walls without any ribs.

As described, the tread support 300 has a top head portion 304 that is larger than a bottom pin portion 306. The bottom pin portion 306 of the tread support 300 engages with a corresponding hole or recess in the leg extension206*a*, 206*b*, so that the top head portion 304 of the tread support 300 is protruding a sufficient amount from a side of the leg extension 206*a*, 206*b* to support the tread 208. The bottom surface of the tread 208 may have a recess with a corresponding shape to the top head portion 304 of the tread support 300. The tread supports 300, which secure the treads 208 to the leg extensions 206*a*, 206*b*, can be engaged with, or connected to, the leg extensions 206*a*, 206*b* by simply pressing the tread support 300 into holes or recesses 214*a*, 214*b* in the leg extensions 206*a*, 206*b*, there are no tools required for assembling the pool ladder 200. This allows any user to assemble the ladder 200 without a customer representative or without having to purchase specific tools for assembly.

Figure 4A:
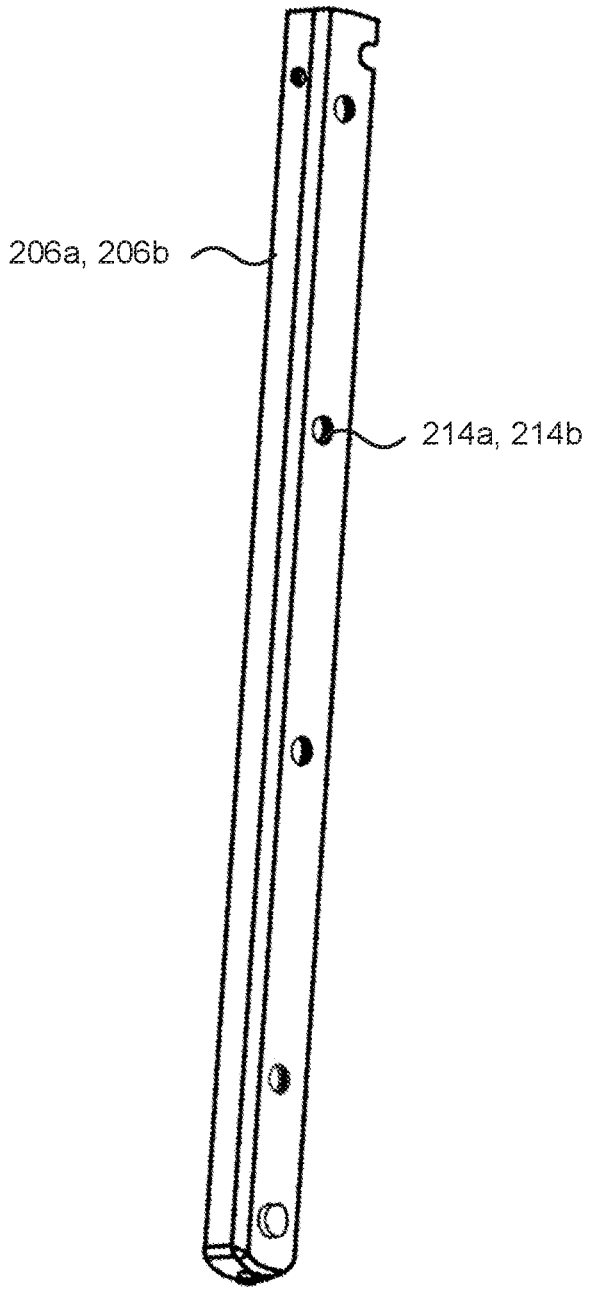
FIGS. 4A and 4B depict the leg extension.
Figure 4B:
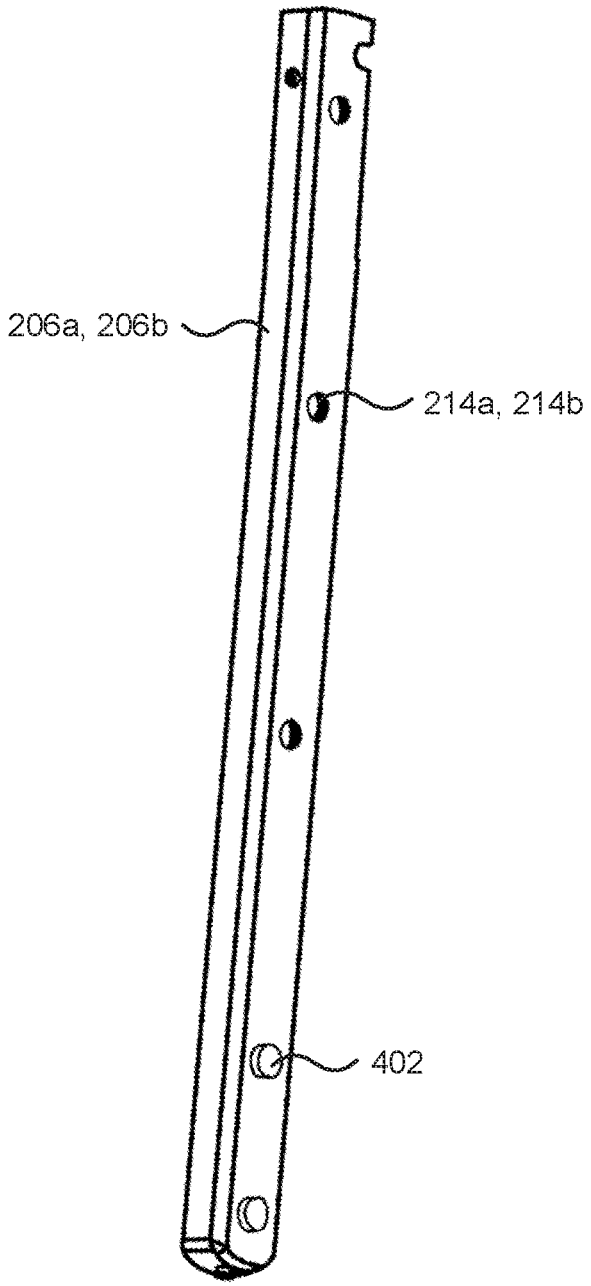

FIGS. 4A and 4B show an isometric view of the leg extension 206*a*, 206*b* before any treads 208 are assembled onto it. The holes 214*a*, 214*b* of the leg extensions 206*a*, 206*b* may be equally spaced apart so that if there are multiple treads 208 assembled onto the ladder 100, then the treads 208 may be equally spaced along the leg extensions 206*a*, 206*b*. To meet the requirements of the APSP ladder codes, the holes 214*a*, 214*b* should be spaced so that the distance between the top surface of a tread 208 to the top surface of another tread 208 is between 7 and 12 inches. The leg extensions 206*a*, 206*b* may have a single set of holes 214*a*, 214*b* for locating treads in a particular location or the legs may have multiple hole locations for each tread position, allowing different tread spacing to be provided.

Each of the leg extension 206*a*, 206*b* may have a fixed tread support 402 closer to a bottom end of the leg extensions 206*a*, 206*b* as shown in FIG. 4B. The fixed tread support 402 may be used to connect a tread 208 to the leg extensions 206*a*, 206*b* instead of tread supports 212*a*, 212*b*. The fixed tread support 402 may be placed below and equally spaced from the holes 214*a*, 214*b* on the leg extensions 206*a*, 206*b*. The number of holes 214*a*, 214*b*, and fixed tread support 402 on each of the leg extensions 206*a*, 206*b* may correspond to the number of treads 208 for the ladder 100. The fixed tread support 402 may be round in shape and may protrude from a side of the leg extension 206*a*, 206*b* as shown in FIG. 4B. The fixed tread support 402 may be similar in shape and size to the top portion 304 of the tread supports 212*a*, 212*b* when their bottom portions 306 are engaged with holes 214*a*, 214*b* in the leg extensions 206*a*, 206*b*. Similar to the tread supports 212*a*, 212*b*, the shape of the fixed tread support 402 may match the shape of the curved recesses of the tread 208. The similar shape of the fixed tread support 402 and the top portion 304 of the tread supports 212*a*, 212*b* may allow for the same type to tread 208 to fit both the fixed tread support 402 and the tread support 212*a*, 212*b*. It will be appreciated that the top portion 304 of the tread supports 212*a*, 212*b* and the fixed tread support 402 may have a common diameter. This means that the same tread may be used for all tread supports 212*a*, 212*b* and fixed supports 402. This allows for easier manufacturing and installation of the ladder, as different tread types may not be required.

The user may assemble a tread 208 onto the leg extensions 206*a*, 206*b* by sliding the tread 208 onto each of the leg extensions 206*a*, 206*b* through the through-holes 110*a*, 110*b* in the tread 208. Recesses in the bottom of the tread 208 may then engage with the supports 402 on each of the leg extensions 206*a*, 206*b*. The fixed tread supports 402 may protrude from the leg extensions 206*a*, 206*b* a sufficient amount, similar to the tread supports 212*a*, 212*b*, so as to prevent the tread 208 from sliding past the location of the fixed tread support 402 on the leg extensions 206*a*, 206*b*. If the fixed tread support 402 does not protrude a sufficient amount, then the tread 208 may not be secured in place. If the tread 208 is not properly secured at the fixed tread support 402 location, then when the user steps on the tread 208, the tread 208 may slide and cause injury to the user.

The engagement between the tread supports 212*a*, 212*b* and/or the fixed tread supports 402 and the recesses on the tread 208 may be a snap mechanism, where the tread support 212*a*, 212*b* and/or the support 402 is friction fit into the recess of the treads 208. The tread supports 212*a*, 212*b* may be secured to the tread 208 once engaged to the leg extensions so that the tread supports 212*a*, 212*b* may not be disengaged from the tread 208 once the recesses have engaged with the tread supports 212*a*, 212*b*.

Figure 5:
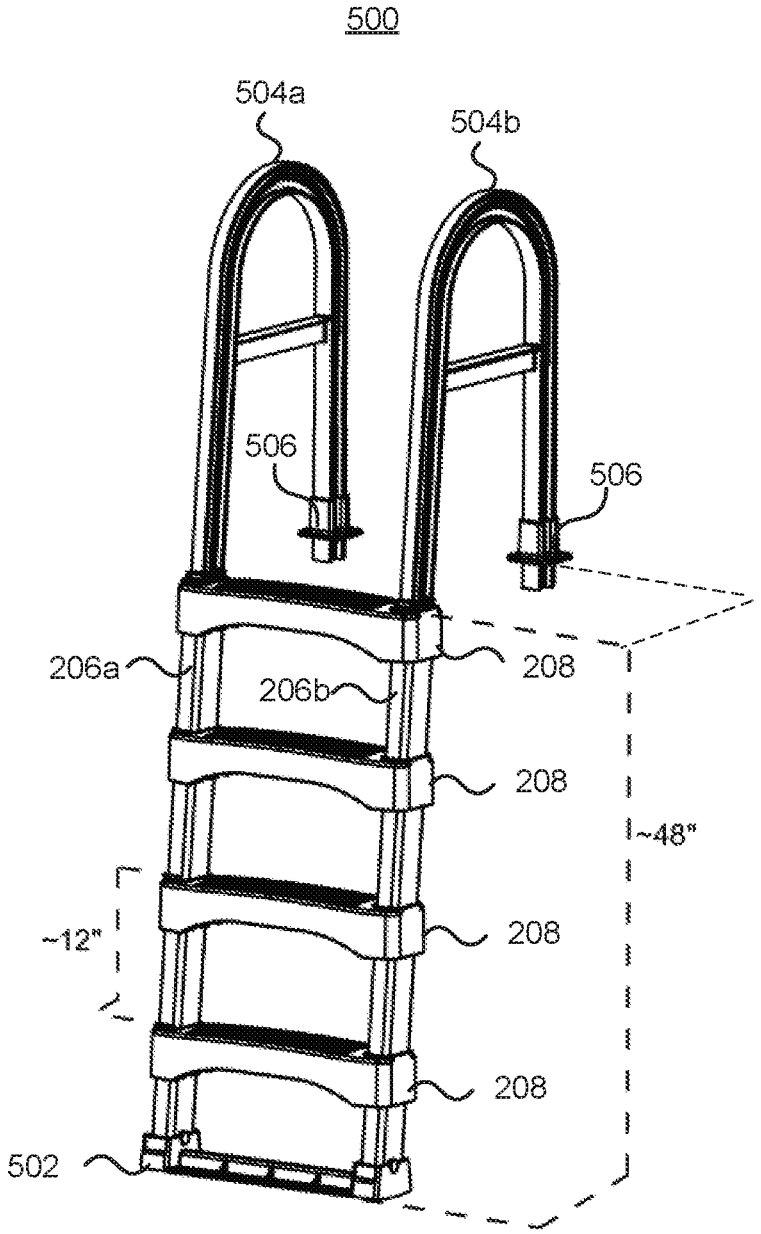
FIG. 5 depicts an implementation of the ladder.

FIG. 5 depicts an assembled ladder. The ladder 500 has four treads 208 that are spaced about 12 inches apart. The treads 208 are connected to the leg extension 206*a*, 206*b* with eight tread supports 212*a*, 212*b* engaged in four holes 214*a*, 214*b* spaced along each of the leg extensions 206*a*, 206*b*. One of the treads 208 may be connected to the leg extensions 206*a*, 206*b* with supports 402, closer to a bottom end of the ladder 100. In that case, each leg extension 206*a*, 206*b* may have a support 402 and three holes 214*a*, 214*b* spaced along their lengths. If the leg extensions 206*a*, 206*b* have three holes 214*a*, 214*b* and a support 402, then the ladder 500 may be assembled with a first tread being slidingly received by the leg extensions 206*a*, 206*b* and engaging with the supports 402 at a bottom end of the leg extensions 206*a*, 206*b*. Once the first tread is connected, then the remaining treads may be connected using tread supports 212*a*, 212*b*.

For the ladder 500 to meet the requirements of the APSP ladder codes and to be used for deck heights of about 48 inches to about 60 inches, the treads 208 should be equally spaced along the leg extensions 206*a*, 206*b* at a minimum spacing distance of 7 inches and a maximum spacing distance of 12 inches. The top tread 208 may be placed at a height of about 48 inches from the bottom surface of the pool. The remaining treads 208 may be spaced about 12 inches apart. This distance may be measured from the top of one tread 208 to the top of the next tread 208 as shown in FIG. 5. In this case, if the deck surface is about 60 inches from the bottom surface of the pool, then the top tread 208 is about 12 inches from the deck surface. This means that none of the treads 208 is spaced more than 12 inches apart, so each step the user would make to enter or exit the pool may be about 12 inches in height, which is in compliance with the APSP ladder codes.

Figure 8A:
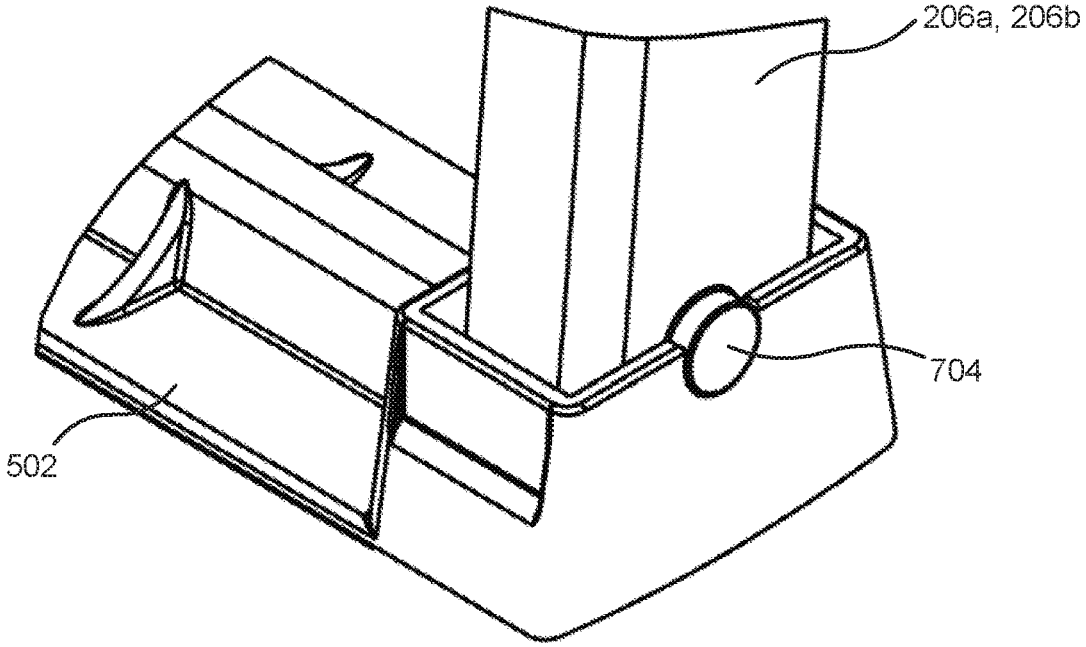
FIGS. 8A, 8B, and 8C depict the connection between the leg extension and the base component.
Figure 8B:
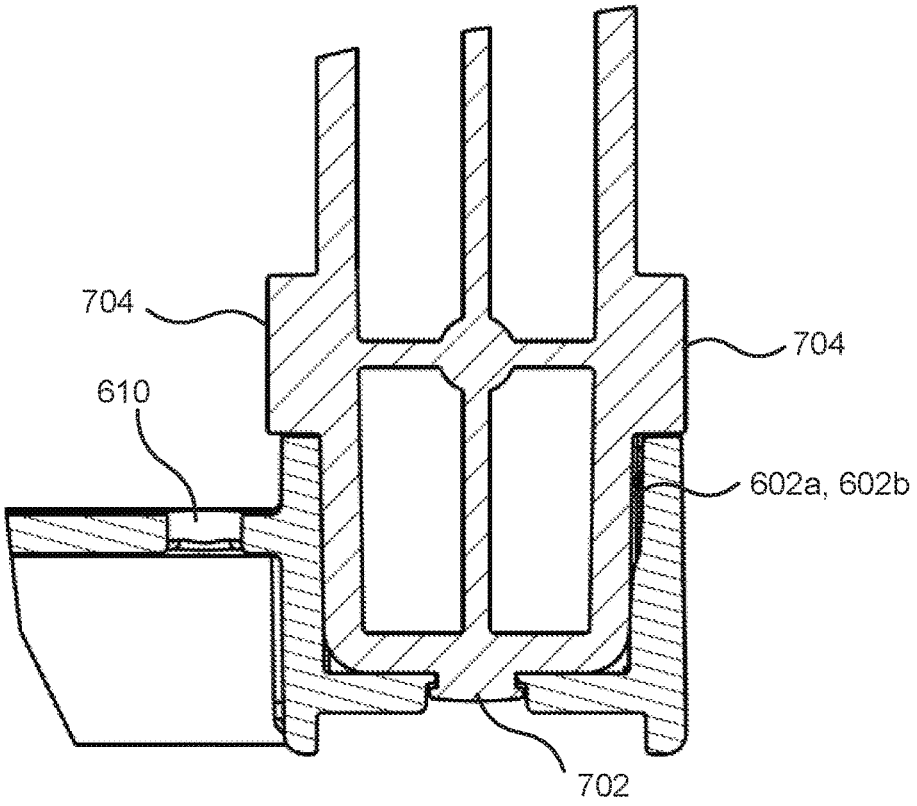
Figure 8C:
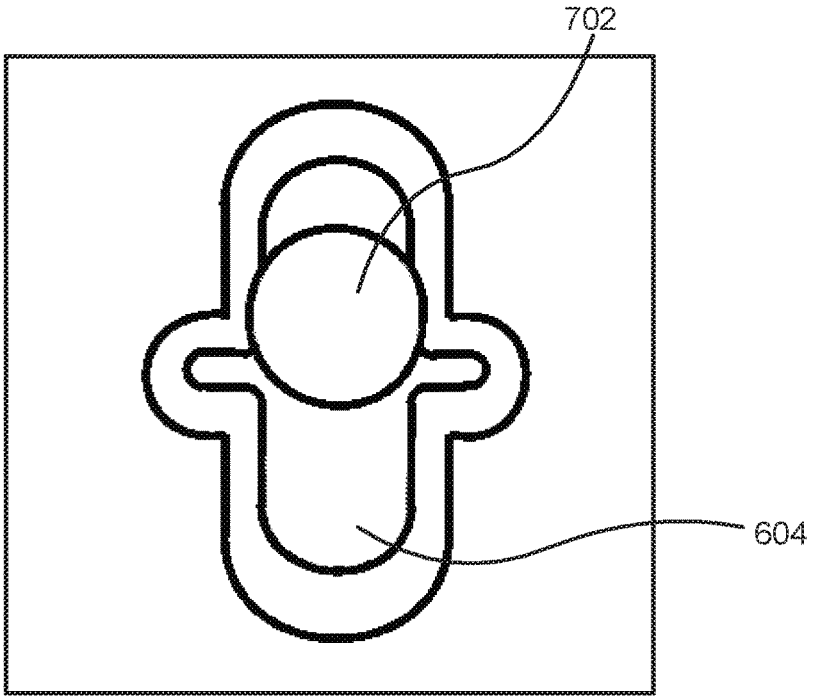

As further depicted in FIG. 5, the ladder 500 may also comprise a base component 502 that rests on the bottom surface of the pool. The base component 502 may connect to each leg extension 206*a*, 206*b* via pockets 602*a*, 602*b* (see FIG. 6A) that may be molded on the base component 502. The connection of the leg extensions 206*a*, 206*b* and the base component 502 may be a connection that allows the leg extension 206*a*, 206*b* to pivot relative to the base component 502. The connection of the leg extensions 206*a*, 206*b* with the base component 502 is shown in FIGS. 8A-8C. This pivotal connection may be used to accommodate different pool liner grades or different pool base surfaces because some pools may have an uneven bottom surface. Some pools may have sand at the perimeter under the base surface of the pool, which would mean that the base surface of the pool may have a slight slope, where the perimeter of the base surface of the pool may be higher than the middle area of the base surface of the pool. The pivotal connection between the leg extensions 206*a*, 206*b* and base component 502 allows the base component 502 to sit flat against the base surface of the pool no matter what the slope of the base surface of the pool is.

Figure 6B:
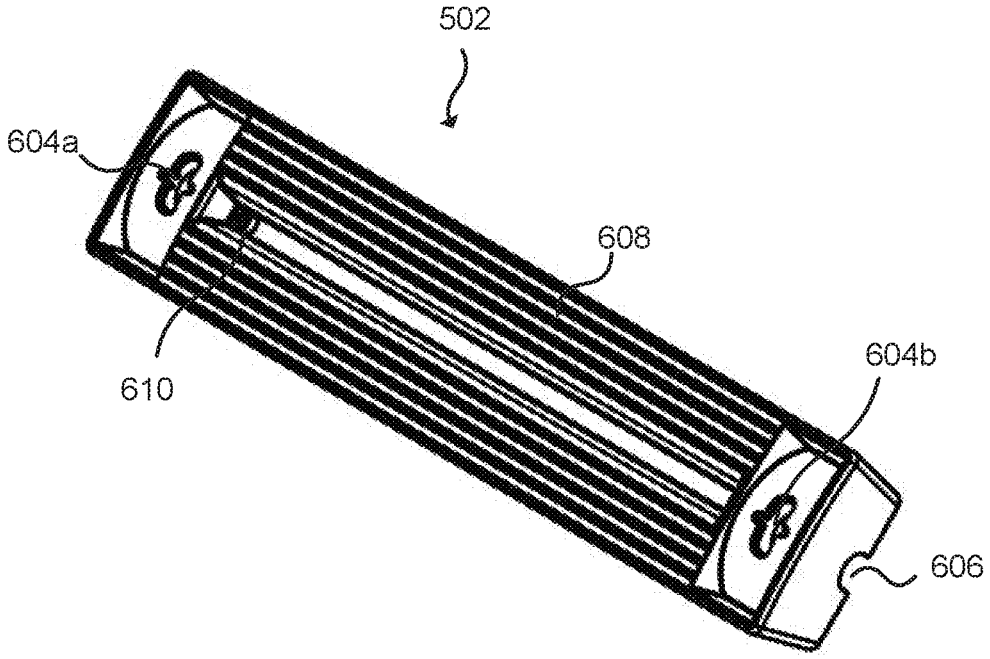
Figure 7:
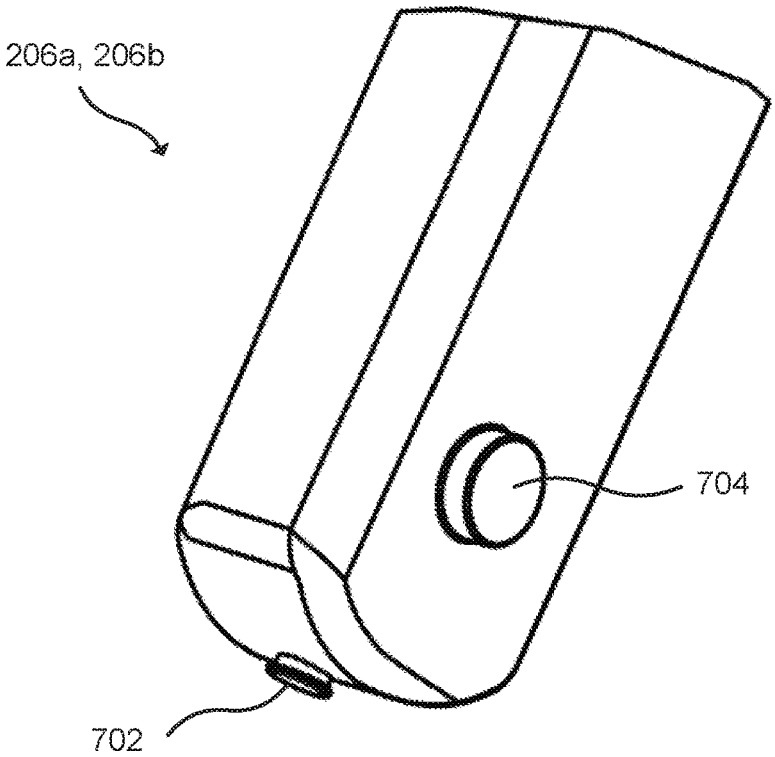
FIG. 7 depicts a bottom end of the leg extension.

To form the pivotal connection, the leg extensions 206*a*, 206*b* may have a tab 702 protruding from their bottom end, as shown in FIG. 7. The tab 702 may protrude from the bottom surface of the leg extension 206*a*, 206*b* (as shown in FIG. 7) or may protrude from any of the sides of the leg extension 206*a*, 206*b*. The tab 702 may have a mushroom shape, where the base of the mushroom is attached to the leg extension 206*a*, 206*b* and the top of the tab 702 has a larger circumference. The mushroom shape of the tab 702 may have a cylindrical base and a cylindrical top, or the tab 702 may have another round or rectangular shape. The tab 702 may be sized to be received by a slotted opening 604 on a bottom face of each of the pockets 602*a*, 602*b* of the base component 502. The slotted opening 604 may have a t shape, as shown in FIG. 6B, with rounded edges, or may have another shape with rounded or square edges. The t shape may allow the tab 702 to snap into the slotted opening 604. The slotted opening 604 may also be grooved.

To connect the leg extensions 206*a*, 206*b* to the base component 502, the bottom ends of each of the leg extensions 206*a*, 206*b* may be received by the pockets 602*a*, 602*b* and then the user may press the tab 702 of the leg extensions 206*a*, 206*b* into the slotted openings 604 of the pockets 602*a*, 602*b*. The t shape of the slotted opening 604 may allow for the tab 702 to snap into place and may also allow the tab 702 to slide from one end of the slotted opening 604 to the opposite end of the slotted opening 604. If the tab 702 has a mushroom shape, the head or top of the mushroom may be pressed through the slotted opening 604 so that the base of the mushroom or the cylindrical area with a smaller radius may slide against the sides of the slotted opening 604. The bottom surface of the pocket 602*a*, 602*b* may be raised from the bottom surface of the base component 502 so that when the tab 702 is snapped into the slotted opening 604, the tab 702 does not touch the bottom surface of the pool. This prevents the pool liner or bottom surface of the pool from being scratched or damaged when the leg extensions 206*a*, 206*b* are pivoted in the base component 502.

To allow for the pivotal connection of the tab 702 sliding in the slotted opening 604, the bottom face of the pockets 602*a*, 602*b* of the base component 502 and the bottom surface of the leg extensions 206*a*, 206*b* may be curved. The curved bottom surface of the leg extensions 206*a*, 206*b* may be formed so that the leg extensions 206*a*, 206*b* may properly sit on the bottom face of the pockets 602*a*, 602*b* once they are received by the pockets 602*a*, 602*b*.

Figure 6A:
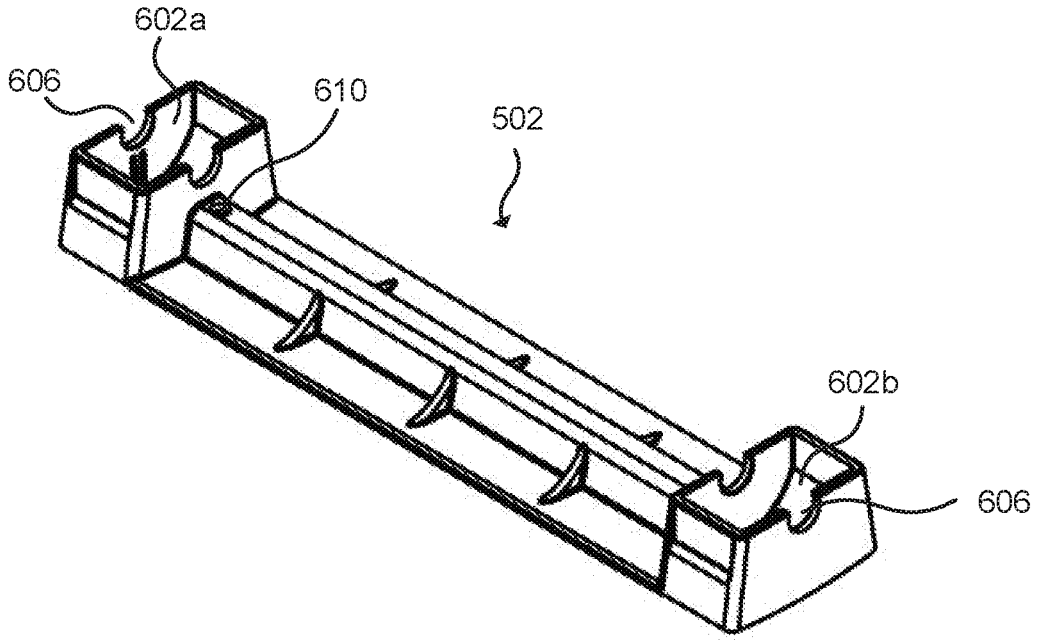
FIGS. 6A and 6B depict an implementation of a base component.

The pivotal connection of the leg extensions 206*a*, 206*b* may also be realized with curved recesses 606 at top edges of opposite sides of the pockets 602, 602*b*, as shown in FIG. 6A. The curved recesses 606 may engage with base supports 704 that may protrude from opposite sides of the leg extensions 206*a*, 206*b*, as shown in FIG. 7. The base supports 704 may be circular in shape or may be another round shape. The curved recesses 606 of the pockets 602*a*, 602*b* may have the same or similar shape to the base supports 704. This allows the base supports 704 to snap into the curved recesses 606 when the leg extensions 206*a*, 206*b* are connected to the base component 502. The round shape of the base supports 704 and the recesses 606 may allow for the leg extensions 206*a*, 206*b* to pivot relative to the pockets 602*a*, 602*b* when the base supports 704 are received by the curved recesses 606.

When the leg extension 206*a*, 206*b* is connected to the base component 502, the engagement of the curved recesses 606 and the base supports 704 may prevent the leg extensions 206*a*, 206*b* from sitting directly on the bottom face of the pockets 602*a*, 602*b*. This will allow for the tab 704 to slide more easily in the slotted opening 604 of the pockets 602*a*, 602*b* which allows for a smooth pivotal connection between the leg extensions 206*a*, 206*b* and the base component 502.

During assembly, when the user is pressing the tab 704 into the slotted opening 604, it will be appreciated that they ensure the base supports 704 are in line with the curved recesses 606. This will allow the base supports 704 to properly sit in the curved recesses 606 once the leg extension 206*a*, 206*b* and the base component 502 are connected. The pivotal connection between the leg extensions 206*a*, 206*b* and the base component 502 may be realised with one or more of the connection of the tab 702 and the slotted opening 604, the curved bottom face of the pockets 602*a*, 602*b* and the leg extension 206*a*, 206*b*, and the connection of the base supports 704 and the curved recesses 606. This pivotal connection can be used to angle the bottom surface of the base component 502 to accommodate the uneven slope of the bottom pool surface or liner.

FIG. 8A depicts a top isometric view of the connection between the leg extension 206*a*, 206*b* and the base component 502. The base supports 704 are sitting in or are received by the curved recesses 606, and the bottom end of the leg extension 206*a*, 206*b* is received by the pocket 602*a*, 602*b*. FIG. 8B depicts the cross-sectional view of the connection. As shown in FIG. 8B, the tab 702 is snapped into the slotted opening 604, and the base supports 704 are sitting in the curved recesses 606. FIG. 8C shows a bottom view of the connection, where the tab 704 is snapped into the slotted opening 604. The top portion of the tab 704 has been pressed through the slotted opening 604, and the bottom portion of the tab 704 can slide along the length of the slotted opening 604. As further depicted in FIG. 8B, the leg extensions 206*a*, 206*b* may have hollow cavities. It will be appreciated that the leg extensions 206*a*, 206*b* may be formed with hollow cavities or may be a solid piece.

Figure 9A:
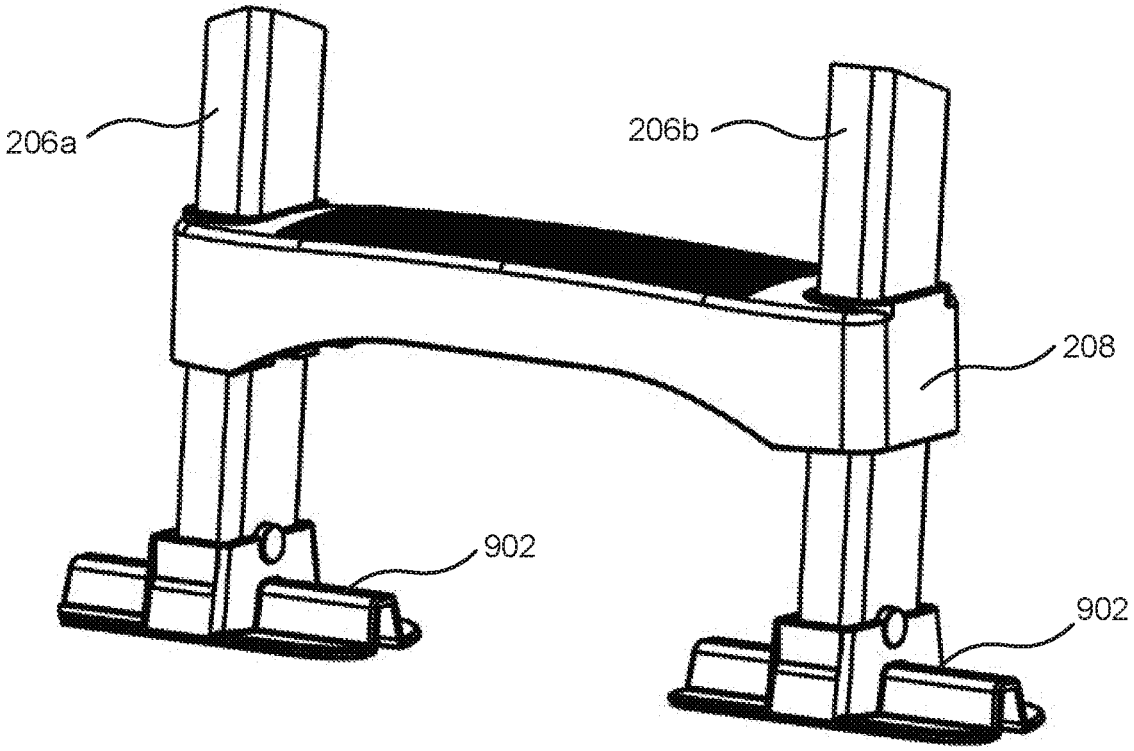
FIGS. 9A and 9B depict an implementation of the base component.
Figure 9B:
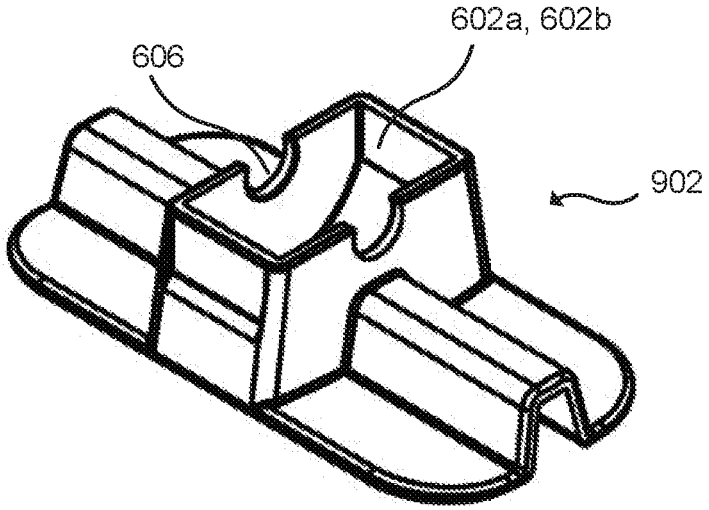

The base component 502 may be a one piece base component, as shown in FIGS. 6A and 6B, or may be a two piece base component 902, as shown in FIGS. 9A and 9B. The two piece base component 902 may have one pocket 602*a*, 602*b* per each piece of the two piece base component 902.

When the one piece base component is used for assembly, the one piece base component may have holes 610 on its top face. If the one piece base component was placed at the bottom of a pool without the holes 610, then air may be captured under the one piece base component and may cause the base component to float. To prevent any floatation of the base component 502, the holes 610 are used to allow air to escape from under the one piece base component when it is placed in a pool. The two piece base component 902 may also have holes to prevent floatation. However, the two piece base component 902, may not have holes as the shape of the two piece base component 902 may prevent any air being trapped. The two piece base component 902 may have openings at its sides, as shown in FIG. 9B, that allow air to escape from under it when it is placed in a pool.

As described above, the pivotal connection of the leg extension 206*a*, 206*b* and the base component 502 allows the base component 502 to sufficiently pivot relative to the leg extension 206*a*, 206*b* so that the bottom surface of the base component 502 may sit relatively flat on different pool liner grades or different pool base surfaces. The two piece base component 902 may be preferred for uneven or unsymmetrical pool bottom surfaces, as each leg extension 206*a*, 206*b* would have its own base component 902 to pivot accordingly based on the slope of the bottom surface of the pool.

To prevent any damage to the pool liner or base surface of the pool, the base component 502 may have a slightly radiused bottom to prevent edges of base component 502 from damaging the pool liner or base surface of the pool. The base component 502 may also have ridges 608 on its bottom face to prevent it from slipping or sliding along the bottom of the pool. The ridges 608 may also be referred to as anti-skid ribs. The ridges 608 may be formed of small raised half round ribs that run parallel to the length of the base component 502 to prevent slippage of the base component 502 against the bottom surface or liner of the pool.

Figure 10:
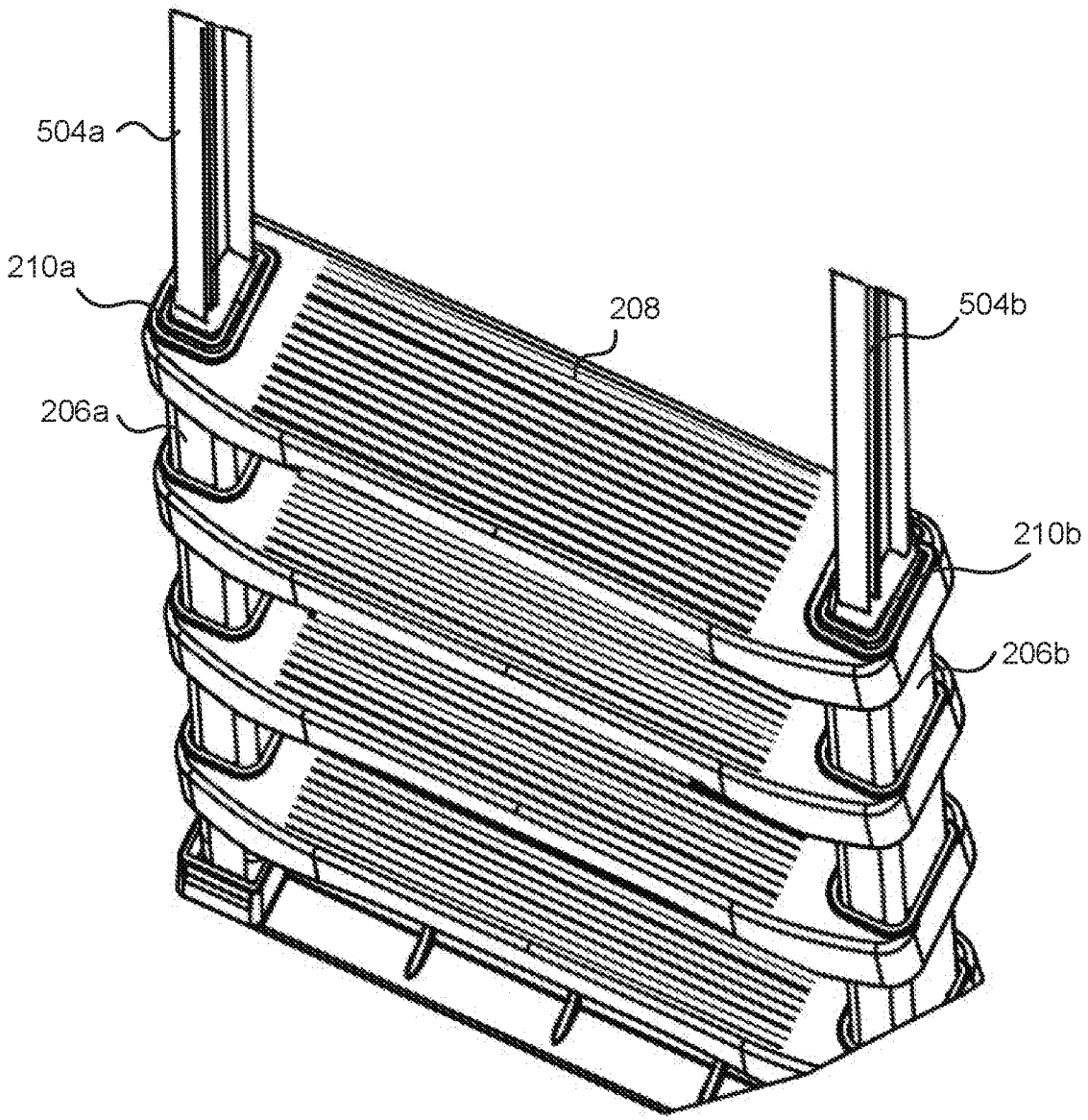
FIG. 10 depicts a top isometric view of the ladder.

With reference to the implementation of the ladder 500 shown in FIG. 5, the ladder 500 may further comprise handrails 504*a*, 504*b* that may be removably connected to a top end of the leg extensions 206*a*, 206*b*. The handrails 504*a*, 504*b* may be used to help the user enter and exit the pool and may also be used to secure the ladder 500 to a deck surface. The handrails 504*a*, 504*b* may have a generally parabolic shape as shown in FIG. 5, or the handrails 504*a*, 504*b* may have a generally rectangular, triangular or other type shape. A top view of the connection between the handrails 504*a*, 504*b* and the leg extensions 206*a*, 206*b* is shown in FIG. 10, where the through-holes 110*a*, 110*b* of a tread 208 are sized to be slidingly received by the connection of the handrail 504*a*, 504*b* and the leg extension 206*a*, 206*b*.

Figure 11:
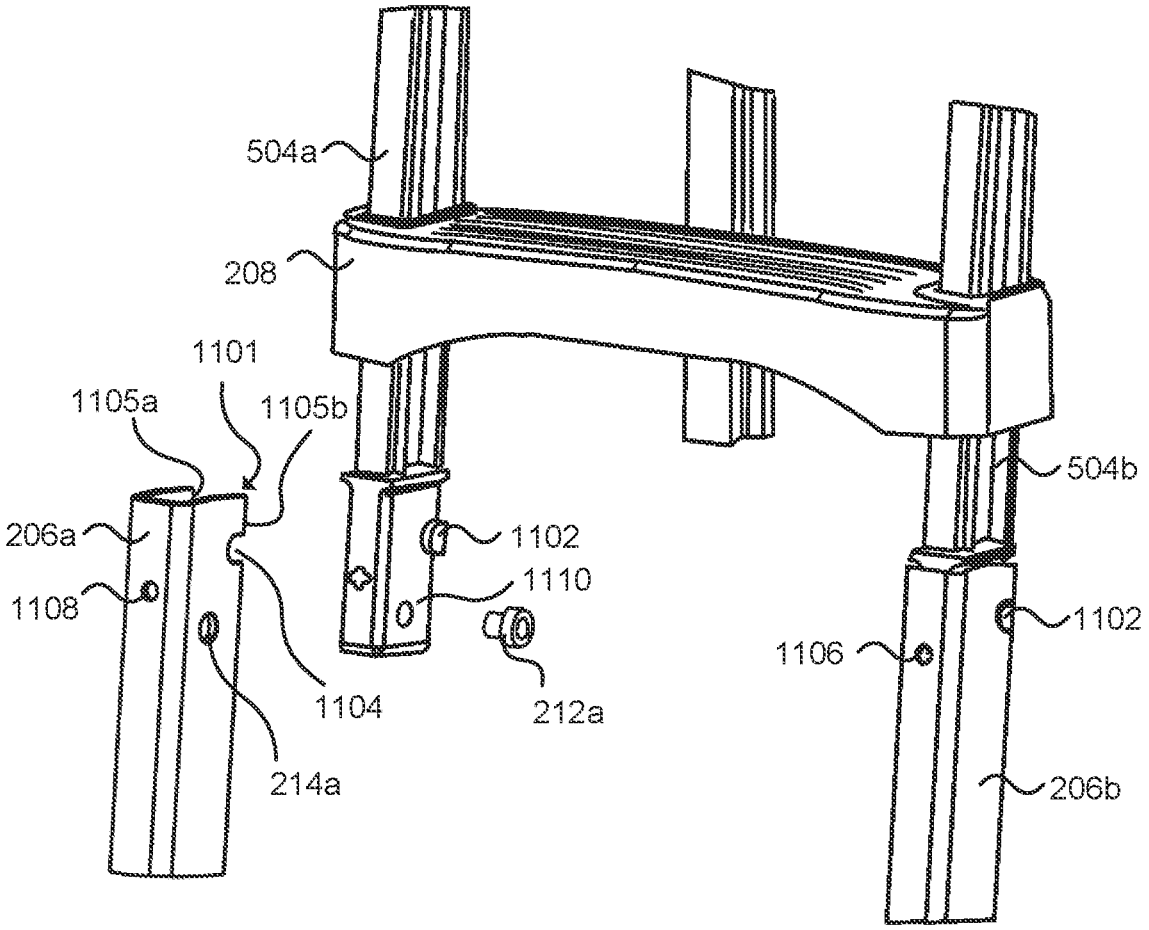
FIG. 11 depicts an assembly of handrails and leg extensions.

To form the connection, an end of the handrails 504*a*, 504*b* may be formed so that they can be received by an opening at a top end of the leg extensions 206*a*, 206*b*. The opening in a top end of the leg extensions 206*a*, 206*b* may be a top opening in the leg extension 206*a*, 206*b*, or a top and side opening in the leg extension 206*a*, 206*b*, as shown in FIG. 11 (also seen as upper portion 1101 of a side surface of the leg extensions). To assemble the connection, a user may place the end of the handrail 504*a*, 504*b* into the opening in the leg extension 206*a*, 206*b*. To ensure the components are properly lined up with each other for the connection, the handrails 504*a*, 504*b* may have alignment tabs 1102 protruding from opposite sides of the handrail 504*a*, 504*b*. The leg extension 206*a*, 206*b* may comprise curved recesses 1104 on opposite edges (e.g. side edge 1105*a* and opposite side edge 1105*b*) of the opening in the leg extension 206*a*, 206*b*. The curved recesses 1104 may engage with the alignment tabs 1102 when the handrail 504*a*, 504*b* is received by the leg extension 206*a*, 206*b*. The curved recesses 1104 and the alignment tabs 1102 may be round or rectangular in shape, and the shape of the curved recesses 1104 and the alignment tabs 1102 may be similar. The engagement of the alignment tabs 1102 and the curved recesses 1104 may be similar to the engagement between the tread supports 212*a*, 212*b* and the tread 208 or may be similar to the base supports 704 sitting in the curved recesses 606.

The handrail 504*a*, 504*b* may further comprise an additional alignment tab 1106 at an adjacent side to the opposite sides of the handrail 504*a*, 504*b*, as shown in FIG. 11. The leg extension 206*a*, 206*b* may further comprise a small opening 1108 to receive the additional alignment tab 1106. The small opening 1108 and additional alignment tab 1106 may be round or rectangular in shape and may engage in a manner similar to the engagements described above.

To secure the connection between the leg extension 206*a*, 206*b* and the handrail 504*a*, 504*b*, the handrail 504*a*, 504*b* may comprise a hole 1110 which may have a shape similar to that of the holes 214*a*, 214*b* in the leg extensions 206*a*, 206*b*. The hole 1110 may be placed so that when the alignment tabs 1102, 1106 are engaged with the curved recesses 1104 and the small opening 1108, the hole 1110 may be in line with a top hole 214*a*, 214*b* of the leg extension 206*a*, 206*b*. A tread support 212*a*, 212*b* may then be placed into the opening of the holes 214*a*, 214*b*, 1106. A tread 208 may then be slidingly received by the connection of the handrail 504*a*, 504*b* and the leg extension 206*a*, 206*b*, as shown in FIG. 10. When the tread 208 is slidingly received by the connection, the recesses in the tread 208 may engage with the tread supports 212*a*, 212*b* that are fit into the holes 214*a*, 214*b*, 1110 of the connection between the handrail 504*a*, 504*b* and the leg extension 206*a*, 206*b*.

Similar to the connection of the tread 208 to the leg extensions 206*a*, 206*b*, the connection between the handrails 504*a*, 504*b* and the leg extensions 206*a*, 206*b* does not require the use of tools. The connection is formed using the end of the handrail 504*a*, 504*b* that is molded to be received by the leg extension 206*a*, 206*b*, tread supports 212*a*, 212*b*, and a tread 208. The components of the ladder 100 described above, allow for an easy toolless assembly that may be performed by any user as the components are formed to engage without the use of any tool.

Figure 12:
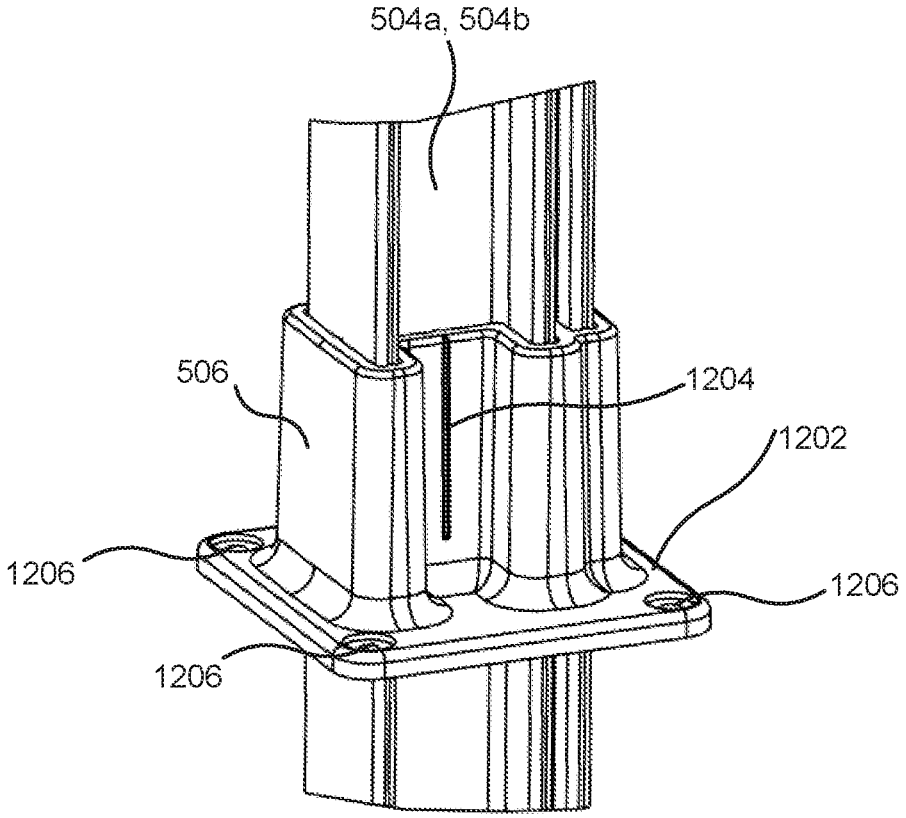
FIG. 12 depicts an implementation of the flange.

After assembly, the ladder 500 may be secured to a deck surface 102 or platform using flanges 506 (see FIGS. 5 and 12). The flanges 506 may be sliding received by an opposite end of the handrails 504*a*, 504*b*, and may be used to connect the ladder 500 to the deck surface 102. To secure the ladder 500, the user may drill openings into their deck surface 102, or the deck surface 102 may already have openings in its surface for the opposite end of the handrails 504*a*, 504*b* to fit into. The openings in the deck may be sized so that the opposite end of the handrail 504*a*, 504*b* may fit through the opening and so that the flanges 506 can sit on the surface of the deck without going through the openings. The flanges 506 may also have a bottom portion 1202 that has a larger bottom surface area to help prevent the flange 506 from going through the opening in the deck and to help secure the flange 506 to the deck.

As shown in FIG. 12, the flange 506 may be shaped to receive ridges that are on the sides of the handrails 504*a*, 504*b*. The inner and outer sides of the handrails 504*a*, 504*b* may have ridges to provide strength and rigidity and to allow for the handrail 504*a*, 504*b* to be more comfortable for the user to grip. There may be multiple ridges on each side of the handrails 504*a*, 504*b* that may vary in width and depth. This variation in width and depth may allow for the handrail 504*a*, 504*b* to be more ergonomic and to have a round shape.

Figure 13:
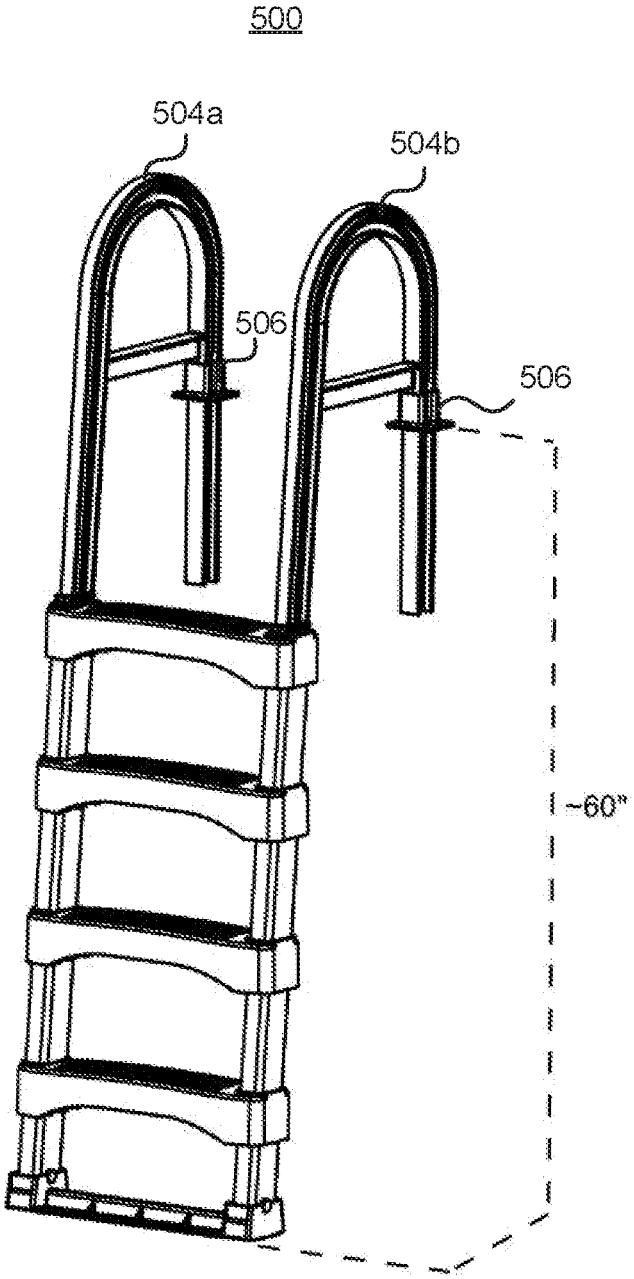
FIG. 13 depicts an implementation of the ladder.
Figure 14:
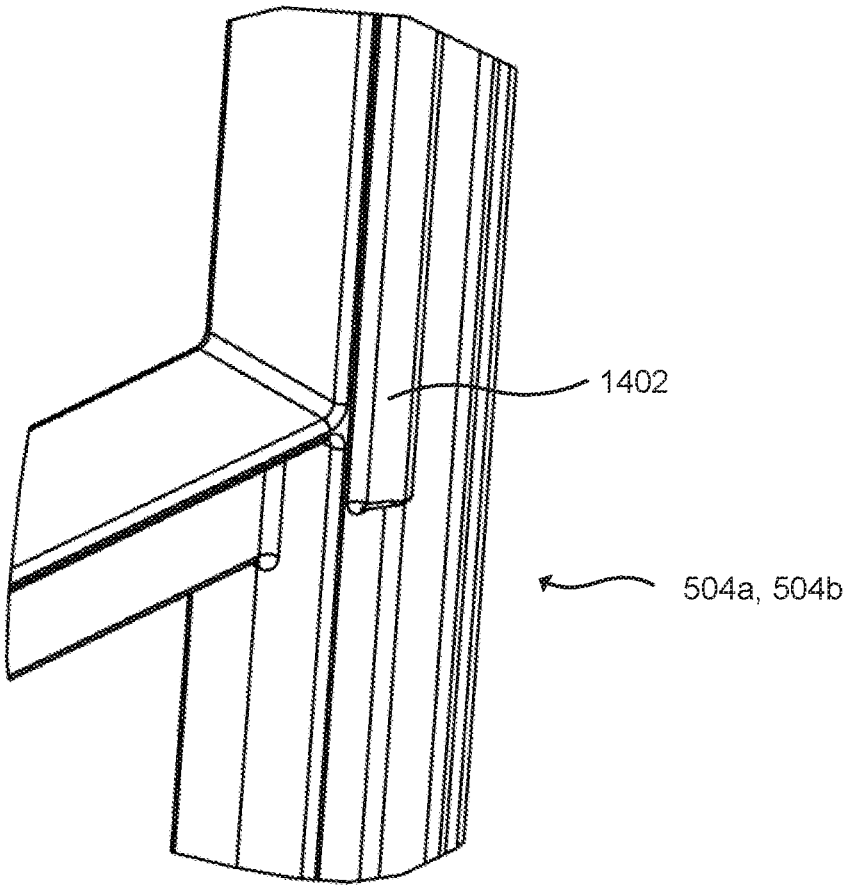
FIG. 14 depicts ridges on the handrail.

The flanges 506 may slidingly receive the handrails 504*a*, 504*b* and may then be secured to the handrails 504*a*, 504*b* at a height on the opposite end of the handrail 504*a*, 504*b* depending on the height of the deck. As shown in FIG. 5, the flanges 506 are connected to the handrail 504*a*, 504*b* at a deck height of about 48 inches. This would mean that the flanges 506 are secured to the handrails 504*a*, 504*b* at a lower point of the handrail 504*a*, 504*b* to accommodate the shorter deck height. As shown in FIG. 13, the flanges 506 may be secured to the handrail at a height of about 60 inches from the bottom surface of the pool. This would mean that the flanges 506 are secured to the handrails 504*a*, 504*b* at a higher point of the handrail 504*a*, 504*b* to accommodate the taller deck height. To ensure that the ladder 500 is used for deck heights ranging from 48 inches to 60 inches, the ridges of the handrail 504*a*, 504*b* may be formed so as to prevent the flange 506 from sliding too high on the handrail 504*a*, 504*b*. The ridges may be formed so that one of the ridges 1402 (see FIG. 14), does not extend the full length of the handrail 504*a*, 504*b*. The ridge 1402 may stop at a location on the handrail 504*a*, 504*b* corresponding to the placement of the flange 506 on the handrail 504*a*, 504*b* when the ladder 500 is used for the tallest deck height (about 60 inches) so that when the flange 506 is slidingly received by the handrail 504*a*, 504*b*, it will not be able to slide past the end of the ridge 1402.

As described above, the flange 506 may be secured to a height on the handrail 504*a*, 504*b* depending on the height of the deck surface 102, allowing the same ladder to be used with varying deck heights. To secure the flange 506 at the appropriate height, the user may use a bolt, screw, nail or other connection means to attach the flange 506 to the handrail 504*a*, 504*b* along a marked line 1204. The marked line 1204 may extend from the top of the flange 506 to the bottom. In a case where the user uses a screw, bolt, or nail to secure the flange 506, the user may need to create the hole for the screw, nail, or bolt in the flange 506 and the handrail 504*a*, 504*b*. It will be appreciated that the handrail 504*a*, 504*b* and/or the flange 506 may be formed with a hole to receive the screw, bolt, or nail. In a case, where the user uses another connection means such as a rivet, the user may still be required to form holes in the flange 506 and handrail 504*a*, 504*b* for the connection means. It will be appreciated that the handrail 504*a*, 504*b* and/or flange 506 may be formed with holes to receive the connection means.

To secure the flange 506 to a deck surface 102, the flange 506 may be screwed, bolted or nailed into the deck surface using the connection holes 1206 in the bottom portion 1202 of the flange 506. The bottom portion 1202 of the flange 506 may extend outward from the center of the flange 506 as shown in FIG. 12, so that the connection holes 1206 may be placed on top of the deck surface 102. It will be appreciated that the flange 506 may be secured to the deck by any other connection means to ensure that the ladder 1500 does not slip or move while in use.

Figure 15:
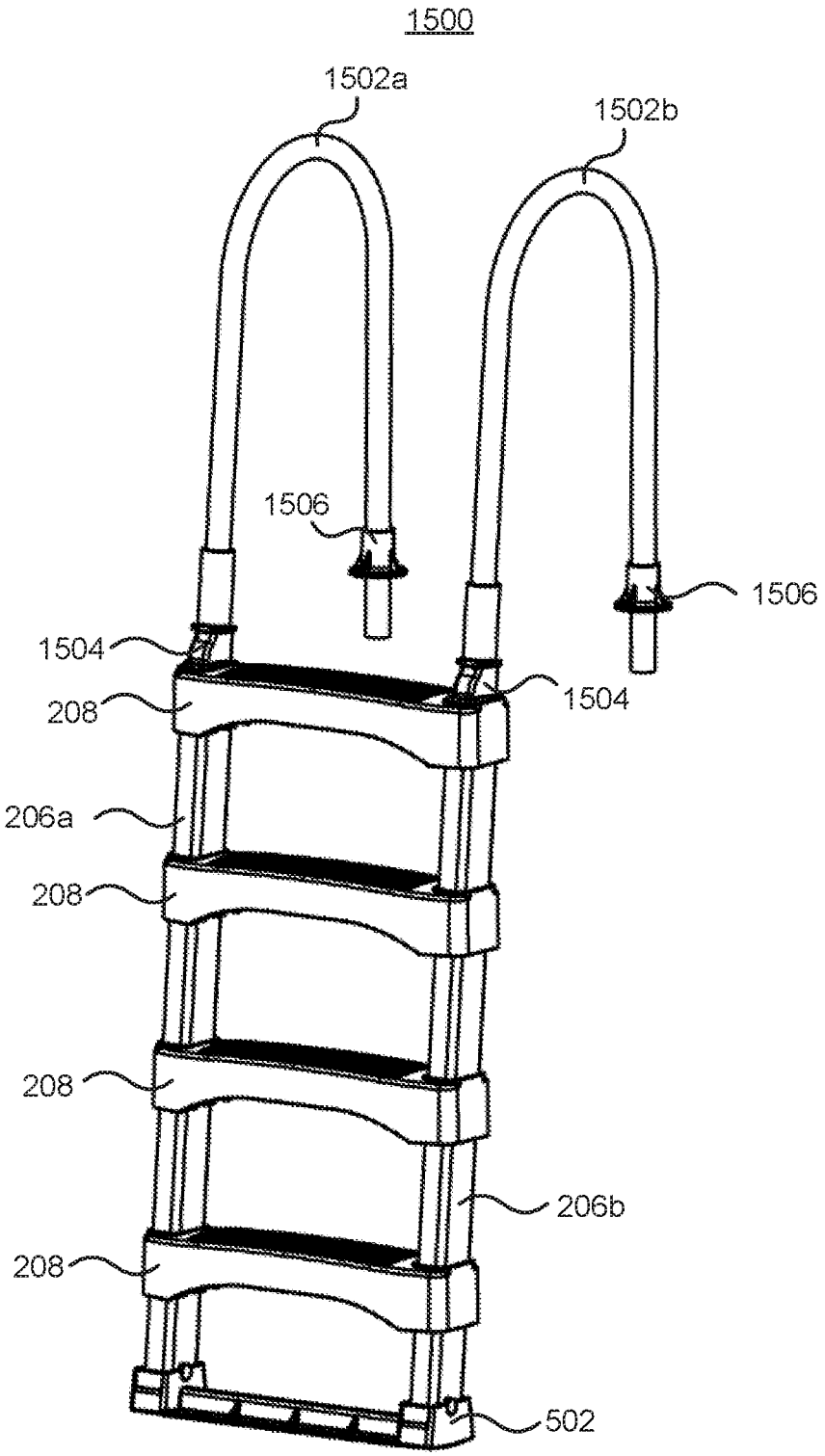
FIG. 15 depicts an implementation of the ladder.

An implementation of the ladder 1500 is shown in FIG. 15, where the handrails 1502*a*, 1502*b* are formed of aluminum. It will be appreciated that the handrails 1502*a*, 1502*b* may be formed of any type of metal material.

Figure 16:
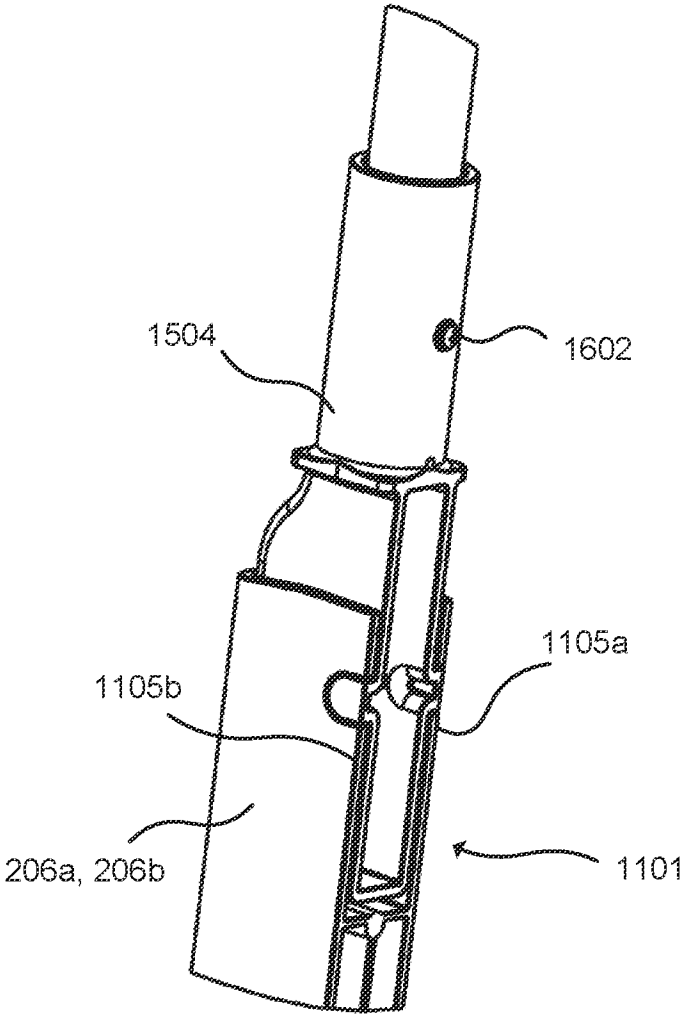
FIG. 16 depicts an additional component for the metal handrails.

The aluminum handrails 1502*a*, 1502*b* may have a round shape to provide an ergonomic grip for the user similar to handrails 504*a*, 504*b*. It will be appreciated that the handrail may have a rectangular or triangular ergonomic grip. The aluminum handrail 1502*a* 1502*b* may not be formed with ridges, or may have some ridges. The aluminum handrails 1502*a*, 1502*b* may connect to the leg extensions 206*a*, 206*b* the same way that the handrails 504*a*, 504*b* connect to the leg extensions 206*a*, 206*b*. The aluminum handrails may be formed with an end having the same shape as the handrail 504*a*, 504*b* or may have an additional component 1504 that has the same shape as the end of the handrail 504*a*, 504*b*. FIG. 16 shows the additional component 1504.

The additional component 1504 may have a bottom portion that has the same shape as the end of the handrail 504*a*, 504*b* and may have a top portion that is formed to slidingly receive an end of the aluminum handrail 1502*a*, 1502*b*. To assemble these components, the additional component 1504 may slidingly receive the aluminum handrail 1502*a*, 1502*b* and then the additional component 1504 may be secured to the aluminum handrail 1502*a*, 1502*b* by a Christmas tree connector 1602. It will be appreciated that a bolt, screw, rivet or other connection means may be used to secure the additional component 1504 to the aluminum handrails 1502*a*, 1502*b*. The user may need to form a hole in the additional component 1504 and the aluminum handrail 1502*a*, 1502*b*, to accommodate the connector 1602, or the aluminum handrail 1502*a*, 1502*b* and/or the additional component 1504 may be formed with holes to accommodate the connector 1602. The Christmas tree connector 1602 may be a nylon rivet with two or three flanges that open up once the connector 1602 is pushed through the hole in the top portion of the additional component 1504 and the hole in the aluminum handrail 1502*a*, 1502*b*. Once the additional component 1504 is secured to the aluminum handrail 1502*a*, 1502*b*, the end of the aluminum handrail 1502*a*, 1502*b* may be connected to the leg extensions 206*a*, 206*b* as described above.

Figure 17:
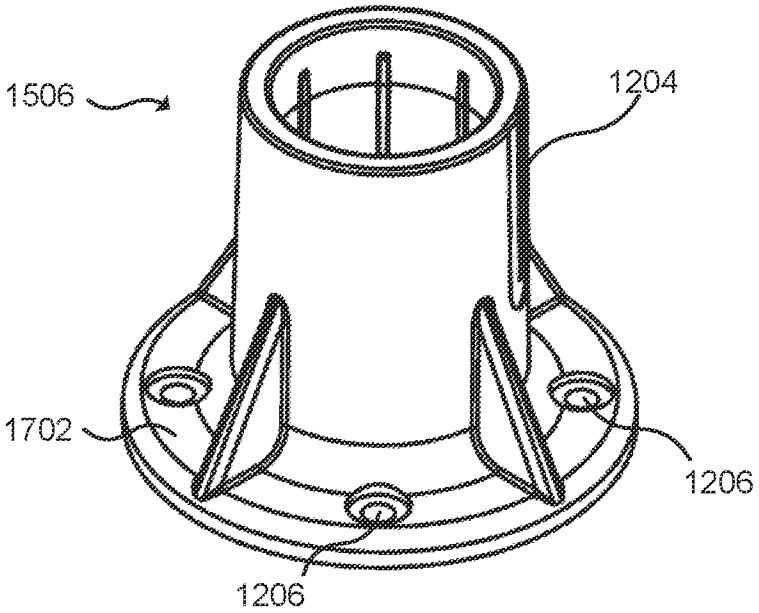
FIG. 17 depicts an implementation of the flange.

If the ladder is assembled with aluminum handrails 1502*a*, 1502*b*, as shown in FIG. 15, the ladder 1500 assembly may comprise different flanges 1506 to accommodate the shape of the aluminum handrail 1502*a*, 1502*b*. This flange 1506 is shown in FIG. 17. The flange 1506 may be round in shape to accommodate the shape of the aluminum handrail 1502*a*, 1502*b* and the flange 1506 may have a bottom portion 1702 that has a larger surface area than a top portion of the flange 1506. The larger bottom surface area of the bottom portion 1702 helps to prevent the flange 1506 from going through the opening in the deck and to help secure the flange 1506 to the deck. As depicted in FIG. 17, the flange 1506 may have connection holes 1206 which may have the same features as the connection holes 1206 of the flange 506 described above. The flange 1506 may also have the marked line 1204 to secure the flange 1506 to the aluminum handrail 1502*a*, 1502*b* similar to the securing method of the flange 506 on the handrail 504*a*, 504*b*.

The assembly of all implementations of the ladder may be formed so that no metal components will touch or be submerged into the water of the pool. Depending on if the pool water is salt water or is chlorinated water, any metal components that touch the water may react with the water. If the pool ladder is formed so that none of the components are resting in or are submerged in the pool water then there is a much lower risk of a reaction between the pool water and the components of the ladder.

The assembly of the ladder may not require the use of any tools. The only tools that may be required for the assembly may be used to secure the ladder to a deck surface 102. This means that a user is able to assemble the ladder without any specific tools and without the help of a customer representative. Because a user is able to assemble the ladder, the ladder may be shipped or delivered to a user unassembled. A ladder that is shipped unassembled may only need a smaller shipping box or container and may be easier to move. The shipping box or container may only need to be as large as the largest component in the assembly. The largest component in the assembly of the ladder may be the leg extensions 206*a*, 206*b* when they are formed as a single piece. However, features of the present invention may allow for the leg extensions 206*a*, 206*b* to still be relatively small, for example, the raised bottom face of the pockets 602*a*, 602*b* of the base component 502 and the shape of the connecting end of the handrail 504*a*, 504*b*. By having a raised bottom face of the pockets 602*a*, 602*b*, the leg extensions 206*a*, 206*b* do not need to be long enough to sit on the bottom surface of the pool. The distance between the bottom surface of the base component 502, which may sit on the bottom surface of the pool and the bottom face of the pockets 602*a*, 602*b* may allow the leg extensions 206*a*, 206*b* to be manufactured with a smaller length. The connecting end of the handrails 504*a*, 504*b* may be shaped to be received by the leg extensions 206*a*, 206*b* as described above. The connecting end of the handrail 504*a*, 504*b* may be formed so the connection of the handrail 504*a*, 504*b* and the leg extensions 206*a*, 206*b* may be below the tread 208 that secures the connection. This feature may allow the leg extensions to be formed with a length shorter than the height of the deck surface 102 as the top tread 208 may sit slightly above or slightly below a top end of the leg extensions 206*a*, 206*b*. It will be appreciated that in an implementation, the leg extensions 206*a*, 206*b* are no longer than 46½ inches so that the unassembled ladder may fit into a shipping carton measuring between 47⅞ inches by 6 inches by 20¼ inches and 47⅞ inches by 8 inches by 20¼ inches.

To further simplify the shipping process of the ladder, the ladder may be formed using only plastic components with a single mold process. The mold process is preferably an injection mold process but may be another mold process. The single mold process can allow for all of the components to be formed in a single mold so that when the ladder components are being prepared to be shipped to a user, there is a much lower risk of missing or accidently omitting components required to assemble the ladder, since all components for a ladder are formed in a single mold.

The present invention provides the pool ladder as described above and shown in the figures. The ladder may be shipped to a user unassembled, or the ladder may be shipped fully assembled. If the ladder is shipped unassembled, the smaller size of the components of the ladder allow the components of the ladder to fit inside a standard shipping container. This may allow the manufacturer or company shipping the ladder to avoid any oversize shipping surcharges. It will be appreciated by one skilled in the art that the ladder may be used in environments other than a pool, such as at a kid's playground or play structure.

It would be appreciated by one of ordinary skill in the art that the apparatus and components shown in FIGS. 1-17 may include components not shown in the drawings. For simplicity and clarity of the illustration, elements in the figures are not necessarily to scale, are only schematic and are non-limiting of the elements structures. It will be apparent to persons skilled in the art that a number of variations and modifications can be made without departing from the scope of the invention as defined in the claims.

What is claimed is:

1. A pool ladder comprising:

a first leg extension and a second leg extension, each having a generally continuous profile;

a first tread comprising a first through-hole and a second through-hole, the first through-hole being sized to slidingly receive the generally continuous profile of the first leg extension, and the second through-hole being sized to slidingly receive the generally continuous profile of the second leg extension, wherein the first tread is formed as a single molded element; and a first tread support and a second tread support, the first tread support engageable to the first leg extension at a first tread location on the first leg extension, the second tread support engageable to the second leg extension at a first tread location on the second leg extension, each of the first and second tread support, when engaged to the respective leg extension, protruding from the respective leg extension a sufficient amount to prevent the first and second through-holes of the first tread from sliding past the first tread locations, wherein the first tread comprises a center reinforcing rib extending along a length of a bottom side of the first tread and a camber arranged on a top side of the first tread; and wherein the first tread is configured to deflect under a weight of a user, said deflection of the first tread pushes the center reinforcing rib outwardly against the first tread support to prevent the first tread from disengaging with the first leg extension.

2. The pool ladder of claim 1, further comprising:

a base component comprising a first pocket and a second pocket, the first pocket being sized to receive a bottom end of the first leg extension, the second pocket being sized to receive a bottom end of the second leg extension.

3. The pool ladder of claim 2, wherein the base component is pivotably connected to the first leg extension and the second leg extension.

4. The pool ladder of claim 3, wherein:

the first leg extension comprises a first tab protruding from the bottom end of the first leg extension;

the second leg extension comprises a second tab protruding from the bottom end of the second leg extension; and the first pocket and the second pocket each comprise a curved bottom surface with a slotted opening, the first tab being slidably connected to the slotted opening of the first pocket, the second tab being slidably connected to the slotted opening of the second pocket.

5. The pool ladder of claim 2, wherein the bottom end of the first leg extension comprises a first base support protruding from opposite sides of the first leg extension;

the bottom end of the second leg extension comprises a second base support protruding from opposite sides of the second leg extension;

a top edge of a side of the first pocket and a top edge of an opposite side of the first pocket each comprise a curved recess, each of the curved recesses of the first pocket being shaped to pivotably receive the first base support; and a top edge of a side of the second pocket and a top edge of an opposite side of the second pocket each comprising a curved recess, each of the curved recesses of the second pocket being shaped to pivotably receive the second base support.

6. The pool ladder of claim 2, wherein the base component is formed of two components; and wherein a first component of the base component comprises the first pocket, and a second component of the base component comprises the second pocket.

7. The pool ladder of claim 2, wherein the base component is one component comprising both the first pocket and the second pocket.

8. The pool ladder of claim 1, further comprising:

a first handrail removably connected to a top end of the first leg extension; and a second handrail removably connected to a top end of the second leg extension, wherein the first handrail is slidingly received within the first leg extension, and the second handrail is slidingly received within the second leg extension.

9. The pool ladder of claim 8, wherein the first and second handrails are sliding received through an opening in a top surface of the respective first and second leg extensions.

10. The pool ladder of claim 8, wherein the first and second handrails are slidingly received through an opening in a top surface and an upper portion of a side surface of the respective first and second leg extensions.

11. The pool ladder of claim 10, wherein both a side edge and an opposite side edge of each of the openings in the first and second leg extensions comprise a recess, each of the recesses receiving handrail tabs;

wherein each of the first handrail and the second handrail comprise at least two of the handrail tabs; and wherein one of the handrail tabs protrudes from a side of the first and second handrails and another handrail tab protrudes from an opposite side of the first and second handrails.

12. The pool ladder of claim 8, further comprising:

a top tread comprising a first through-hole and a second through-hole, the first through-hole of the top tread being sized to slidingly receive the removable connection of the first handrail and the first leg extension, and the second through-hole of the top tread being sized to slidingly receive the removable connection of the second handrail and the second leg extension; and a third tread support and a fourth tread support, the third tread support engaged at a top tread location on the first leg extension and being separate from the first leg extension, the fourth tread support engaged at a top tread location on the second leg extension and being separate from the second leg extension, each of the third and fourth tread supports protruding from the respective leg extension the sufficient amount when engaged to prevent the first and second through-holes of the top tread from sliding past the top tread locations.

13. The pool ladder of claim 1, further comprising:

a second tread comprising a first through-hole and a second through-hole, the first through-hole of the second tread being sized to slidingly receive the generally continuous profile of the first leg extension, and the second through-hole of the second tread being sized to slidingly receive the generally continuous profile of the second leg extension; and a fifth tread support and a sixth tread support, the fifth tread support engaged at a second tread location on the first leg extension and being separate from the first leg extension, the second tread support engaged at a second tread location on the second leg extension and being separate from the second leg extension, each of the fifth and sixth tread supports protruding from the respective leg extension a sufficient amount when engaged to prevent the first and second through-holes of the second tread from sliding past the second tread locations.

14. The pool ladder of claim 13, further comprising:

a third tread comprising a first through-hole and a second through-hole, the first through-hole of the third tread being sized to slidingly receive the generally continuous profile of the first leg extension, and the second through-hole of the third tread being sized to slidingly receive the generally continuous profile of the second leg extension; and a seventh tread support and an eighth tread support, the seventh tread support engaged at a third tread location on the first leg extension and being separate from the first leg extension, the eighth tread support engaged at a third tread location on the second leg extension and being separate from the second leg extension, each of the seventh and eighth tread supports protruding from the respective leg extension a sufficient amount when engaged to prevent the first and second through-holes of the third tread from sliding past the third tread locations.

15. A kit for assembling the pool ladder of claim 1, comprising the pool ladder of claim 1.

16. The kit of claim 15, further comprising:

a base component.

17. The kit of claim 15, further comprising:

a first handrail; and a second handrail.

18. The kit of claim 15, further comprising:

a top tread;

a third tread support; and a fourth tread support.

19. A method of producing the kit of claim 15, comprising: providing the kit of claim 15 and molding kit parts.

20. The method of claim 19, wherein the kit parts are molded in a single mold.

* * * * *